US009024979B2

(12) United States Patent
Lee et al.

(10) Patent No.: US 9,024,979 B2
(45) Date of Patent: May 5, 2015

(54) LIQUID CRYSTAL DISPLAY PANEL, LIQUID CRYSTAL DISPLAY DEVICE, AND METHOD OF DRIVING A LIQUID CRYSTAL DISPLAY DEVICE

(75) Inventors: Seung-Kyu Lee, Yongin (KR); Dong-Hoon Lee, Yongin (KR); Chul-Ho Kim, Yongin (KR); Jin-Woo Park, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 219 days.

(21) Appl. No.: 13/103,348

(22) Filed: May 9, 2011

(65) Prior Publication Data

US 2012/0105494 A1 May 3, 2012

(30) Foreign Application Priority Data

Oct. 28, 2010 (KR) ..... 10-2010-0105654

(51) Int. Cl.
*G09G 5/10* (2006.01)
*G09G 3/36* (2006.01)

(52) U.S. Cl.
CPC ..... *G09G 3/3648* (2013.01); *G09G 3/3614* (2013.01); *G09G 2300/0426* (2013.01); *G09G 2310/0248* (2013.01); *G09G 2320/0209* (2013.01); *G09G 2320/0247* (2013.01); *G09G 2330/023* (2013.01)

(58) Field of Classification Search
USPC ..... 345/204, 92, 87, 96, 99, 209, 211, 212, 345/100, 95
See application file for complete search history.

(56) References Cited

U.S. PATENT DOCUMENTS 6,483,494 B1 * 11/2002 Liaw et al. ..... 345/92
7,586,476 B2 * 9/2009 Kwon et al. ..... 345/98
7,737,940 B2 * 6/2010 Wu et al. ..... 345/104
8,009,124 B2 * 8/2011 Kim ..... 345/67

(Continued)

FOREIGN PATENT DOCUMENTS

CN 1577013 A 2/2005
CN 1959480 A 5/2007

(Continued)

OTHER PUBLICATIONS

European Search Report dated Jan. 2, 2012, for corresponding European Patent application 11171204.8, 11 pages.

(Continued)

*Primary Examiner* — Quan-Zhen Wang
*Assistant Examiner* — Chun-Nan Lin
(74) *Attorney, Agent, or Firm* — Christie, Parker & Hale, LLP

(57) ABSTRACT

A liquid crystal display (LCD) panel is disclosed. The LCD panel includes a plurality of pixels arranged in rows and columns, a first sub gate-line coupled to first row-pixels that are adjacent to a lower side of the first sub gate-line, a second sub gate-line coupled to second row-pixels that are adjacent to an upper side of the second sub gate-line, a plurality of gate-lines between the first sub gate-line and the second sub gate-line, a plurality of even data-lines coupled to first column-pixels that are adjacent to the even data-lines, and a plurality of odd data-lines coupled to second column-pixels that are adjacent to the odd data-lines. Here, each gate-line of the plurality of gate lines is coupled to first row-pixels that are adjacent to a lower side of the gate-line and second row-pixels that are adjacent to an upper side of the gate-line.

18 Claims, 19 Drawing Sheets

(56) References Cited

U.S. PATENT DOCUMENTS

| | | | | |
|---|---|---|---|---|
| 8,063,867 | B2 * | 11/2011 | Song et al. | 345/99 |
| 8,199,099 | B2 * | 6/2012 | Kwon et al. | 345/100 |
| 8,248,352 | B2 * | 8/2012 | Kim et al. | 345/99 |
| 8,502,948 | B2 * | 8/2013 | Su et al. | 349/143 |
| 8,736,781 | B2 * | 5/2014 | Lee | 349/48 |
| 2003/0112213 | A1 | 6/2003 | Noguchi et al. | |
| 2003/0189537 | A1 | 10/2003 | Yun | |
| 2004/0263743 | A1 * | 12/2004 | Kim et al. | 349/139 |
| 2005/0046620 | A1 * | 3/2005 | Lee et al. | 345/90 |
| 2005/0099378 | A1 | 5/2005 | Kim | |
| 2006/0081850 | A1 | 4/2006 | Lee et al. | |
| 2006/0125755 | A1 * | 6/2006 | Noguchi et al. | 345/96 |
| 2006/0139281 | A1 * | 6/2006 | Park | 345/96 |
| 2006/0284815 | A1 * | 12/2006 | Kwon et al. | 345/98 |
| 2007/0097072 | A1 * | 5/2007 | Kim et al. | 345/103 |
| 2007/0182685 | A1 * | 8/2007 | Park et al. | 345/96 |
| 2007/0182718 | A1 * | 8/2007 | Schoener et al. | 345/173 |
| 2007/0229430 | A1 * | 10/2007 | Wang et al. | 345/96 |
| 2008/0042957 | A1 * | 2/2008 | Hsu | 345/93 |
| 2008/0278427 | A1 * | 11/2008 | Jang et al. | 345/98 |
| 2008/0291430 | A1 * | 11/2008 | Nozawa | 356/73 |
| 2009/0051634 | A1 * | 2/2009 | Chen | 345/87 |
| 2009/0116279 | A1 * | 5/2009 | Maeda et al. | 365/154 |
| 2009/0207118 | A1 * | 8/2009 | Lee et al. | 345/98 |
| 2009/0295784 | A1 * | 12/2009 | Kwon et al. | 345/213 |
| 2010/0162109 | A1 * | 6/2010 | Chatterjee et al. | 715/702 |
| 2010/0188374 | A1 * | 7/2010 | Chen et al. | 345/204 |
| 2010/0188887 | A1 * | 7/2010 | Maeda et al. | 365/154 |
| 2010/0231577 | A1 * | 9/2010 | Kim et al. | 345/212 |
| 2010/0253668 | A1 * | 10/2010 | Sugihara et al. | 345/211 |
| 2010/0289791 | A1 * | 11/2010 | Weng | 345/213 |
| 2010/0295843 | A1 * | 11/2010 | Liu et al. | 345/214 |
| 2010/0315396 | A1 * | 12/2010 | Weng et al. | 345/208 |
| 2011/0012758 | A1 * | 1/2011 | Wu et al. | 341/20 |
| 2011/0037914 | A1 * | 2/2011 | Noguchi et al. | 349/37 |
| 2011/0089979 | A1 * | 4/2011 | Chen et al. | 327/108 |
| 2011/0090190 | A1 * | 4/2011 | Lin | 345/205 |
| 2011/0248985 | A1 * | 10/2011 | Lin et al. | 345/214 |
| 2011/0285950 | A1 * | 11/2011 | Su et al. | 349/139 |

FOREIGN PATENT DOCUMENTS

| | | | |
|---|---|---|---|
| EP | 1 037 193 | A2 | 9/2000 |
| JP | 4-67091 | | 3/1992 |
| JP | 11-109313 | | 4/1999 |
| JP | 2003-315766 | | 11/2003 |
| JP | 2006-72360 | A | 3/2006 |
| JP | 2006-350289 | | 12/2006 |
| JP | 2012093702 | A * | 5/2012 |
| KR | 10-2003-0080353 | | 10/2003 |
| KR | 10-2005-0001249 | | 1/2005 |
| KR | 10-2005-0003631 | | 1/2005 |
| KR | 10-2005-0048317 | | 5/2005 |
| WO | WO 99/12072 | | 3/1999 |
| WO | WO 2007/108150 | A1 | 9/2007 |

OTHER PUBLICATIONS

KIPO Notice of Allowance dated Sep. 24, 2012, for Korean priority Patent application 10-2010-0105654, (5 pages).

Office Action dated Nov. 6, 2012 issued in Japanese Patent Application No. 2011-051377, 2 pages.

* cited by examiner

FIG. 4

| | | 140_1 | 150_1 | 140_2 | 150_2 | 140_3 | 150_3 | 140_4 | 150_4 | |
|---|---|---|---|---|---|---|---|---|---|---|
| | | DL1 | DL2 | DL3 | DL4 | DL5 | DL6 | DL7 | DL8 | |
| 1F | 1H | + | − | + | − | + | − | + | − | |
| | 2H | + | − | + | − | + | − | + | − | |
| | 3H | + | − | + | − | + | − | + | − | |
| | 4H | + | − | + | − | + | − | + | − | ... |
| | 5H | + | − | + | − | + | − | + | − | |
| | 6H | + | − | + | − | + | − | + | − | |
| | 7H | + | − | + | − | + | − | + | − | |
| | 8H | + | − | + | − | + | − | + | − | |
| | ⋮ | ⋮ | ⋮ | ⋮ | ⋮ | ⋮ | ⋮ | ⋮ | ⋮ | |

FIG. 6

| | | 140_1 | 150_1 | 140_2 | 150_2 | 140_3 | 150_3 | 140_4 | 150_4 | |
|---|---|---|---|---|---|---|---|---|---|---|
| | | DL1 | DL2 | DL3 | DL4 | DL5 | DL6 | DL7 | DL8 | |
| 2F | 1H | − | + | − | + | − | + | − | + | |
| | 2H | − | + | − | + | − | + | − | + | |
| | 3H | − | + | − | + | − | + | − | + | |
| | 4H | − | + | − | + | − | + | − | + | ... |
| | 5H | − | + | − | + | − | + | − | + | |
| | 6H | − | + | − | + | − | + | − | + | |
| | 7H | − | + | − | + | − | + | − | + | |
| | 8H | − | + | − | + | − | + | − | + | |
| | ⋮ | ⋮ | ⋮ | ⋮ | ⋮ | ⋮ | ⋮ | ⋮ | ⋮ | |

LIQUID CRYSTAL DISPLAY PANEL, LIQUID CRYSTAL DISPLAY DEVICE, AND METHOD OF DRIVING A LIQUID CRYSTAL DISPLAY DEVICE

CROSS-REFERENCE TO RELATED APPLICATION

This application claims priority to and the benefit under 35 U.S.C. §119 to Korean Patent Application No. 2010-0105654, filed on Oct. 28, 2010 in the Korean Intellectual Property Office, the entire content of which is incorporated herein by reference.

BACKGROUND

1. Field

Aspects of embodiments according to the present invention relate to a display device. More particularly, aspects of embodiments according to the present invention relate to a liquid crystal display (LCD) panel, an LCD device, and a method of driving an LCD device.

2. Description of Related Art

A liquid crystal display (LCD) device displays an image by forming an electric field (i.e., an electric potential difference) between a pixel electrode and a common electrode of a liquid crystal capacitor included in each pixel. In the liquid crystal capacitor, a liquid crystal layer is placed between the pixel electrode and the common electrode so that light transmittance of the liquid crystal layer is controlled by an intensity of the electric field formed between the pixel electrode and the common electrode. Recently, an LCD device having a thin film transistor (TFT) as a switching element included in each pixel has been in widespread use. This type of LCD device has been referred to as a TFT LCD device.

An LCD device may periodically invert polarities of data signals to reduce or prevent deterioration of the liquid crystal capacitor included in each pixel due to polarization. For example, the LCD device may employ inversion methods such as a dot inversion method, a line inversion method, a column inversion method, a frame inversion method, a Z-inversion method, an active level shift (ALS) inversion method, etc. However, these inversion methods may cause various problems, such as horizontal crosstalk, vertical crosstalk, unnecessary power consumption, etc.

SUMMARY

Example embodiments provide for a liquid crystal display (LCD) panel capable of reducing or preventing horizontal crosstalk and vertical crosstalk while efficiently reducing power consumption. Further, example embodiments provide for an LCD device capable of generating a high quality image by reducing or preventing horizontal crosstalk and vertical crosstalk while efficiently reducing power consumption. In addition, example embodiments provide for a method of driving an LCD device capable of reducing or preventing horizontal crosstalk and vertical crosstalk while efficiently reducing power consumption.

In an exemplary embodiment according to the present invention, a liquid crystal display (LCD) panel is disclosed. The LCD panel includes a plurality of pixels, a first sub gate-line, a second sub gate-line, a plurality of gate lines, a plurality of even data lines, and a plurality of odd data-lines. The plurality of pixels is arranged in rows and columns. The first sub gate-line is coupled to first row-pixels that are adjacent to a lower side of the first sub gate-line. The second sub gate-line is coupled to second row-pixels that are adjacent to an upper side of the second sub gate-line. The plurality of gate-lines is between the first sub gate-line and the second sub gate-line. Each gate-line of the plurality of gate-lines is coupled to first row-pixels that are adjacent to a lower side of the gate-line and second row-pixels that are adjacent to an upper side of the gate-line. The plurality of even data-lines is coupled to first column-pixels that are adjacent to the even data-lines. The plurality of odd data-lines is coupled to second column-pixels that are adjacent to the odd data-lines.

The first row-pixels may include odd column row-pixels and the second row-pixels may include even column row-pixels.

The first column-pixels may include odd row column-pixels and the second column-pixels may include even row column-pixels.

The first column-pixels may include even row column-pixels and the second column-pixels may include odd row column-pixels.

The first row-pixels may include even column row-pixels and the second row-pixels may include odd column row-pixels.

The first column-pixels may include odd row column-pixels and the second column-pixels may include even row column-pixels.

The first column-pixels may include even row column-pixels and the second column-pixels may include odd row column-pixels.

In an odd frame, the odd data-lines may be configured to receive data signals of a first polarity and the even data-lines may be configured to receive data signals of a second polarity, the second polarity being opposite to the first polarity.

In an even frame, the odd data-lines may be configured to receive data signals of the second polarity and the even data-lines may be configured to receive data signals of the first polarity.

The first polarity may be positive polarity relative to a common voltage and the second polarity may be negative polarity relative to the common voltage.

The first polarity may be negative polarity relative to a common voltage and the second polarity may be positive polarity relative to the common voltage.

The LCD panel may further include a charge-sharing control circuit configured to control the odd data-lines to share electric charges in accordance with a charge-sharing control signal and to control the even data-lines to share electric charges in accordance with the charge-sharing control signal.

The charge-sharing control circuit may include a plurality of first switches and a plurality of second switches. The plurality of first switches is configured to couple the odd data-lines to each other in accordance with the charge-sharing control signal. The plurality of second switches is configured to couple the even data-lines to each other in accordance with the charge-sharing control signal.

The charge-sharing control signal may be a pre charge-sharing (PCS) signal. The first switches and the second switches may be configured to turn on before row-pixels coupled to the first sub gate-line, the second sub gate-line, and the plurality of gate-lines are charged.

The charge-sharing control signal may be a pre charge-sharing (PCS) signal. The first switches and the second switches may be configured to turn on after row-pixels coupled to the first sub gate-line, the second sub gate-line, and the plurality of gate-lines are charged.

Each of the pixels may include a switching element and a liquid crystal capacitor. The switching element is configured to perform switching operations in accordance with a gate signal output from the first sub gate-line, the second sub gate-line, or one of the gate-lines. The liquid crystal capacitor may be configured to control light transmittance of a liquid crystal layer in accordance with a data signal output from one of the odd data-lines or one of the even data-lines.

The switching element may be a thin film transistor (TFT) that includes a gate terminal for receiving the gate signal, a source terminal for receiving the data signal, and a drain terminal for outputting the data signal to the liquid crystal capacitor.

Each of the pixels may further include a storage capacitor configured to maintain a charged voltage of the liquid crystal capacitor.

According to another exemplary embodiment of the present invention, a liquid crystal display (LCD) device is disclosed. The LCD device includes an LCD panel, a source driver, a gate driver, and a timing controller. The LCD panel is configured to apply data signals of a same polarity to odd column row-pixels and even column row-pixels with an interval of one horizontal period in a row direction, and to sequentially apply data signals of alternate polarities to column-pixels with an interval of one horizontal period in a column direction. The source driver is configured to provide data signals to the LCD panel in accordance with a data control signal. The gate driver is configured to provide gate signals corresponding to a scan pulse to the LCD panel in accordance with a gate control signal. The timing controller is configured to generate the data control signal and the gate control signal.

The LCD panel may include a plurality of pixels, a first sub gate-line, a second sub gate-line, a plurality of gate-lines, a plurality of even data-lines, and a plurality of odd data-lines. The plurality of pixels is arranged in rows and columns. The first sub gate-line is coupled to first row-pixels that are adjacent to a lower side of the first sub gate-line. The second sub gate-line is coupled to second row-pixels that are adjacent to an upper side of the second sub gate-line. The plurality of gate-lines is between the first sub gate-line and the second sub gate-line. Each gate-line of the plurality of gate-lines is coupled to first row-pixels that are adjacent to a lower side of the gate-line and second row-pixels that are adjacent to an upper side of the gate-line. The plurality of even data-lines is coupled to first column-pixels that are adjacent to the even data-lines. The plurality of odd data-lines is coupled to second column-pixels that are adjacent to the odd data-lines.

The LCD panel may further include a charge-sharing control circuit configured to control the odd data-lines to share electric charges in accordance with a charge-sharing control signal and to control the even data-lines to share electric charges in accordance with the charge-sharing control signal.

The first row-pixels may include odd column row-pixels and the second row-pixels may include even column row-pixels.

The first column-pixels may include odd row column-pixels and the second column-pixels may include even row column-pixels.

The first column-pixels may include even row column-pixels and the second column-pixels may include odd row column-pixels.

The first row-pixels may include even column row-pixels and the second row-pixels may include odd column row-pixels.

The first column-pixels may include odd row column-pixels and the second column-pixels may include even row column-pixels.

The first column-pixels may include even row column-pixels and the second column-pixels may include odd row column-pixels.

In an odd frame, the odd data-lines may be configured to receive data signals of a first polarity and the even data-lines may be configured to receive data signals of a second polarity, the second polarity being opposite to the first polarity.

In an even frame, the odd data-lines may be configured to receive data signals of the second polarity and the even data-lines may be configured to receive data signals of the first polarity.

According to yet another exemplary embodiment of the present invention, a method of driving a liquid crystal display (LCD) device is disclosed. The method includes: applying data signals of a same polarity to odd column row-pixels and even column row-pixels with an interval of one horizontal period in a row direction; sequentially applying data signals of alternate polarities to column-pixels with an interval of one horizontal period in a column direction; and inverting polarities of data signals provided to an LCD panel with each frame.

According to example embodiments, an LCD panel may reduce power consumption by decreasing a pulse repetition frequency of data signals (i.e., variance of data signals) provided to data-fines in each frame, may reduce or prevent horizontal crosstalk by applying data signals of the same polarity to odd column row-pixels and even column row-pixels with an interval of one horizontal period in a row direction, and may reduce or prevent vertical crosstalk by sequentially applying data signals of alternate polarities to column-pixels with an interval of one horizontal period in a column direction. Here, row-pixels describe a plurality of pixels that are common to one row (including a subset of the pixels of one row, such as every other pixel), and column-pixels describe a plurality of pixels that are common to one column (including a subset of the pixels of one column, such as every other pixel).

Additionally, an LCD device having the LCD panel may generate a high quality image by reducing or preventing horizontal crosstalk and vertical crosstalk while efficiently reducing power consumption. Furthermore, a method of driving an LCD device may reduce or prevent horizontal crosstalk and vertical crosstalk while efficiently reducing power consumption.

BRIEF DESCRIPTION OF THE DRAWINGS

Example embodiments can be understood in more detail from the following description taken in conjunction with the accompanying drawings.

FIG. 4 is a diagram illustrating an example of providing data signals to the LCD panel of FIG. 1 in an odd frame.

FIG. 6 is a diagram illustrating an example of providing data signals to the LCD panel of FIG. 1 in an even frame.

DETAILED DESCRIPTION

Figure 1:
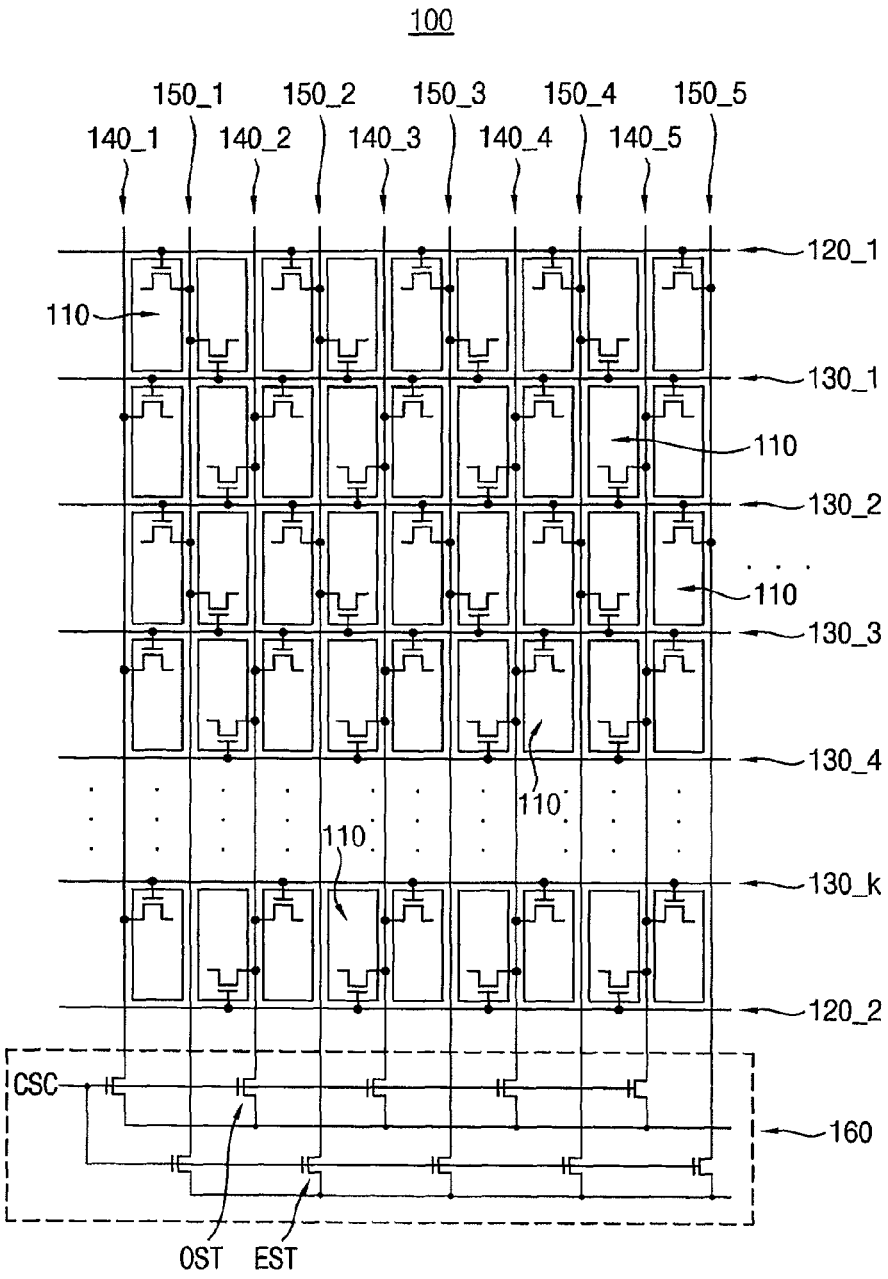
FIG. 1 is a diagram illustrating a liquid crystal display (LCD) panel in accordance with example embodiments.

The example embodiments are described more fully hereinafter with reference to the accompanying drawings. The present invention may, however, be embodied in many different forms and should not be construed as limited to the example embodiments set forth herein. In the drawings, the sizes and relative sizes of layers and regions may be exaggerated for clarity.

It will be understood that when an element or layer is referred to as being "on," "connected to," or "coupled to" another element or layer, it can be directly on, directly connected, or directly coupled to the other element or layer, or intervening elements or layers may also be present. In contrast, when an element is referred to as being "directly on," "directly connected to," or "directly coupled to" another element or layer, there are no intervening elements or layers present. Like or similar reference numerals refer to like or similar elements throughout. As used herein, the term "and/or" includes any combination of one or more of the associated listed items.

It will be understood that, although the terms first, second, third, etc., may be used herein to describe various elements, components, regions, layers, patterns, and/or sections, these elements, components, regions, layers, patterns, and/or sections should not be limited by these terms. These terms are only used to distinguish one element, component, region, layer, pattern, or section from another element, component, region, layer, pattern, or section. Thus, a first element, component, region, layer, pattern, or section discussed below could be termed a second element, component, region, layer, pattern, or section without departing from the teachings of example embodiments.

Spatially relative terms, such as "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for describing particular example embodiments only and is not intended to be limiting of the present invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross sectional illustrations that are schematic illustrations of illustratively idealized example embodiments (and intermediate structures) of the present invention. As such, variations from the shapes of the illustrations because of, for example, manufacturing techniques and/or tolerances, are to be expected. Thus, example embodiments should not be construed as limited to the particular shapes of regions illustrated herein but are to include variations in shapes that result, for example, from manufacturing. The regions illustrated in the figures are schematic in nature and their shapes are not intended to illustrate the actual shape of a region of a device and are not intended to limit the scope of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a diagram illustrating a liquid crystal display (LCD) panel 100 in accordance with example embodiments.

Referring to FIG. 1, the LCD panel 100 includes a plurality of pixels 110, a first sub gate-line 120_1, a second sub gate-line 120_2, a plurality of gate-lines 130_1 through 130_*k*, a plurality of odd data-lines 140_1 through 140_5, and a plurality of even data-lines 150_1 through 150_5. The first sub gate-line 120_1, the second sub gate-line 120_2, and the plurality of gate-lines 130_1 through 130_*k* are collectively referred to as row-lines. In some example embodiments, the LCD panel 100 further includes a charge-sharing control circuit 160. In the embodiment of FIG. 1, for ease of illustration, five odd data lines 140_1 through 140_5 and five even data lines 150_1 through 150_5 are shown and described. However, the LCD panel 100 may contain another number of data lines without departing from the spirit or scope of the present invention.

An LCD device displays an image by forming an electric field (i.e., an electric potential difference) between a pixel electrode and a common electrode of a liquid crystal capacitor included in each pixel. In the liquid crystal capacitor, a liquid crystal layer is placed between the pixel electrode and the common electrode so that light transmittance of the liquid crystal layer is controlled by an intensity of the electric field formed between the pixel electrode and the common electrode.

Here, if the electric field is formed between the pixel electrode and the common electrode in one direction for a long time, the liquid crystal capacitor may deteriorate due to polarization. Hence, the LCD device may periodically invert polarities of data signals to reduce or prevent the deterioration of the liquid crystal capacitor included in each pixel. For example, the LCD device may employ inversion methods such as a dot inversion method, a line inversion method, a column inversion method, a frame inversion method, a Z-inversion method, an active level shift (ALS) inversion method, etc.

The dot inversion method inverts polarities of data signals with respect to alternating dots. Namely, a certain pixel receives a data signal having a polarity opposite to data signals received by its adjacent pixels in both a vertical direction (i.e., a column direction) and a horizontal direction (i.e., a row direction). The line inversion method inverts polarities of data signals with respect to alternating gate-lines (for example, rows). The column inversion method inverts polarities of data signals with respect to alternating data-lines (for example, columns). The frame inversion method inverts polarities of data signals with respect to alternating frames (for example, odd frames and even frames).

The Z-inversion method arranges a plurality of pixels in zigzags of a column direction. Thus, the Z-inversion method substantially performs the dot inversion when data signals are applied to the pixels in a similar way to the column inversion method. The ALS inversion method substantially inverts polarities of data signals in a similar way to the line inversion method. Here, the ALS inversion method may reduce a voltage displacement applied to a common electrode compared to the line inversion method.

However, these inversion methods may result in various problems. For example, the dot inversion method may reduce or prevent vertical crosstalk and/or horizontal crosstalk because a certain pixel receives a data signal having a polarity opposite to data signals received by its adjacent pixels in a vertical direction (i.e., a column direction) and a horizontal direction (i.e., a row direction). However, the dot inversion method may consume high power because a pulse repetition frequency of data signals (i.e., variance of data signals) is relatively high as the dot inversion method inverts polarities of data signals with respect to alternating dots.

In comparison, the line inversion method may reduce power consumption compared to the dot inversion method because a pulse repetition frequency of data signals (i.e., variance of data signals) is decreased. However, the line inversion method may cause horizontal crosstalk because the line inversion method inverts polarities of data signals with respect to alternating gate-lines. The column inversion method may also reduce power consumption compared to the dot inversion method because a pulse repetition frequency of data signals (i.e., variance of data signals) is decreased. However, the column inversion method may cause vertical crosstalk because the column inversion method inverts polarities of data signals with respect to alternating data-lines.

As for the other inversion methods mentioned above, the frame inversion method may cause flickers when frames are changed because the frame inversion method inverts polarities of data signals with respect to alternating frames. By contrast, the Z-inversion method may reduce power consumption compared to the dot inversion method because the Z-inversion method applies data signals to the pixels in a similar way to the column inversion method. However, the Z-inversion method may cause vertical stripes in case that data signals have specific patterns. Finally, the ALS inversion method may reduce power consumption compared to the line inversion method because a voltage displacement applied to a common electrode is small compared to the line inversion method. However, the ALS inversion method may cause horizontal crosstalk because the ALS inversion method inverts polarities of data signals with respect to alternating gate-lines.

For overcoming various problems of these inversion methods, the LCD panel 100 includes the pixels 110, the first sub gate-line 120_1, the second sub gate-line 120_2, the gate-lines 130_1 through 130_*k*, the odd data-lines 140_1 through 140_5, and the even data-lines 150_1 through 150_5. The pixels 110 are arranged in a matrix manner (that is, in rows and columns) at portions corresponding to crossing regions of the first sub gate-line 120_1, the second sub gate-line 120_2, the gate-lines 130_1 through 130_*k*, the odd data-lines 140_1 through 140_5, and the even data-lines 150_1 through 150_5.

Here, each of the pixels 110 is coupled to the first sub gate-line 120_1, the second sub gate-line 120_2, or one of the gate-lines 130_1 through 130_*k* via a gate terminal of its switching element (e.g., a TFT). Additionally, each of the pixels 110 is coupled to one of the odd data-lines 140_1 through 140_5 or one of the even data-lines 150_1 through 150_5 via a source terminal of its switching element. As a result, each of the pixels 110 receives a gate signal (i.e., a scan pulse) output from the first sub gate-line 120_1, the second sub gate-line 120_2, or one of the gate-lines 130_1 through 130_*k* via the gate terminal of its switching element and receives a data signal output from one of the odd data-lines 140_1 through 140_5 or one of the even data-lines 150_1 through 150_5 via the source terminal of its switching element.

In some example embodiments, each of the pixels 110 includes a thin film transistor (TFT, i.e., the switching element), a liquid crystal capacitor, and a storage capacitor. Here, the liquid crystal capacitor includes a pixel electrode for receiving the data signal, a common electrode for receiving the common voltage, and a liquid crystal layer placed between the pixel electrode and the common electrode. See, for example, the representative pixel in FIG. 2. The liquid crystal layer includes a dielectric anisotropy material.

In the embodiment of FIG. 1, the first sub gate-line 120_1 and the second sub gate-line 120_2 are placed at peripheries of the display area, with the gate-lines 130_1 through 130_*k* therebetween. In one example embodiment, the first sub gate-line 120_1 is coupled to first row-pixels that are adjacent to a lower side of the first sub gate-line 120_1. Here, "row-pixels" describe a plurality of pixels that are common to one row, including a subset of the pixels of one row (such as every other pixel). For example, in one embodiment, first row-pixels correspond to (for example, are or include) the odd column row-pixels (that is, those pixels in one row that are also in the odd columns). Likewise, the second sub gate-line 120_2 is coupled to second row-pixels that are adjacent to an upper side of the second sub gate-line 120_2. For example, in one embodiment, second row-pixels correspond to (for example, are or include) even column row-pixels (that is, those pixels in one row that are also in the even columns).

The gate-lines 130_1 through 130_*k* are located (for example, placed) between the first sub gate-line 120_1 and the second sub gate-line 120_2. Further, each gate-line of the gate-fines 130_1 through 130_*k* is coupled to second row-pixels that are adjacent to an upper side of the gate-line and to first row-pixels that are adjacent to a lower side of the gate-line.

In other words, each gate-line of the gate-lines 130_1 through 130_*k* is coupled to the pixels 110 in zigzag fashion proceeding in the row direction along the gate-line (that is, the gate-line is alternately coupled to a pixel 110 above the gate-line and to a pixel 110 below the gate-line). Here, as described above, first row-pixels correspond to (for example, are or include) odd column row-pixels and second row-pixels correspond to (for example, are or include) even column row-pixels.

That is, the first sub gate-line 120_1 is coupled to odd column row-pixels that are adjacent to a lower side of the first sub gate-line 120_1, the second sub gate-line 120_2 is coupled to even column row-pixels that are adjacent to an upper side of the second sub gate-line 120_2, and each gate-line of the gate-lines 130_1 through 130_*k* is coupled to even column row-pixels that are adjacent to an upper side of the gate-line and to odd column row-pixels that are adjacent to a lower side of the gate-line.

In the embodiment of FIG. 1, the pixels 110 coupled to the odd data-lines 140_1 through 140_5 are different from the pixels 110 coupled to the even data-lines 150_1 through 150_5. In other words, when the odd data-lines 140_1 through 140_5 are coupled to second column-pixels, then the even data-lines 150_1 through 150_5 are coupled to first column-pixels. Here, "column-pixels" describe a plurality of pixels that are common to one column, including a subset of the pixels of one column. For example, in one embodiment, first column-pixels correspond to (for example, are or include) odd row column-pixels (that is, those pixels in one column that are also in the odd rows) while second column-pixels correspond to (for example, are or include) even row column-pixels (that is, those pixels in one column that are also in the even rows).

In other embodiments, first column-pixels correspond to (for example, are or include) even row column-pixels while second column-pixels correspond to (for example, are or include) odd row column-pixels. In FIG. 1, it is illustrated that the odd data-lines 140_1 through 140_5 are coupled to even row column-pixels and that the even data-lines 150_1 through 150_5 are coupled to odd row column-pixels.

As described above, each of the pixels 110 is coupled to the first sub gate-line 120_1, the second sub gate-line 120_2, or one of the gate-lines 130_1 through 130_*k* via a gate terminal of its switching element (e.g., a TFT). In addition, each of the pixels 110 is coupled to one of the odd data-lines 140_1 through 140_5 or one of the even data-lines 150_1 through 150_5 via a source terminal of its switching element (e.g., a TFT).

In each frame, data signals of a first polarity are applied to the odd data-lines 140_1 through 140_5 and data signals of a second polarity (i.e., opposite to the first polarity) are applied to the even data-lines 150_1 through 150_5. As a result, data signals of the same polarity are applied to odd column row-pixels and even column row-pixels with an interval of one horizontal period in the row direction.

In addition, data signals of alternate polarities are sequentially applied to column-pixels with an interval of one horizontal period in a column direction. That is, the LCD panel 100 substantially receives data signals in a similar way to the column inversion method. For example, in an odd frame, the odd data-lines 140_1 through 140_5 receive data signals of a first polarity while the even data-lines 150_1 through 150_5 receive data signals of a second polarity. Subsequently, in an even frame, the odd data-lines 140_1 through 140_5 receive data signals of the second polarity while the even data-lines 150_1 through 150_5 receive data signals of the first polarity.

The LCD panel 100 may further include the charge-sharing control circuit 160. The charge-sharing control circuit 160 controls the odd data-lines 140_1 through 140_5 to share electric charges and controls the even data-lines 150_1 through 150_5 to share electric charges. In one example embodiment, the charge-sharing control circuit 160 includes a plurality of first switches OST and a plurality of second switches EST. The first switches OST couple the odd data-lines 140_1 through 140_5 to each other in accordance with a charge-sharing control signal CSC. Likewise, the second switches EST couple the even data-lines 150_1 through 150_5 to each other in accordance with the charge-sharing control signal CSC.

For example, in one example embodiment, the charge-sharing control signal CSC is a pre charge-sharing (PCS) signal. In addition, the first switches OST and the second switches EST turn on before the pixels 110 coupled to the row-lines (i.e., the first sub gate-line 120_1, the second sub gate-line 120_2, and the gate-lines 130_1 through 130_*k*) are charged. In another example embodiment, the first switches OST and the second switches EST turn on after the pixels 110 coupled to the row-lines are charged. Thus, the odd data-lines 140_1 through 140_5 share electric charges and the even data-lines 150_1 through 150_5 share electric charges.

In one example embodiment, the first switches OST and the second switches EST are implemented by n-channel metal oxide semiconductor (NMOS) transistors. In this case, when the charge-sharing control signal CSC has a logic "high" voltage level, the first switches OST and the second switches EST turn on. Accordingly, the odd data-lines 140_1 through 140_5 are coupled to each other and the even data-lines 150_1 through 150_5 are coupled to each other.

In another example embodiment, the first switches OST and the second switches EST are implemented by p-channel metal oxide semiconductor (PMOS) transistors. In this case, when the charge-sharing control signal CSC has a logic "low" level, the first switches OST and the second switches EST turn on. Accordingly, the odd data-lines 140_1 through 140_5 are coupled to each other and the even data-lines 150_1 through 150_5 are coupled to each other.

The LCD panel 100 having the charge-sharing control circuit 160 may reduce power consumption in cases such as when data signals have fickle patterns and may enhance charging-characteristics of the pixels 110 to have high performance. In FIG. 1, it is illustrated that the LCD panel 100 includes the charge-sharing control circuit 160. However, the charge-sharing control circuit 160 may be embedded in an integrated circuit (IC) in other embodiments.

As described above, an LCD device may periodically invert polarities of data signals to reduce or prevent deterioration of a liquid crystal capacitor included in each of the pixels 110. Here, since the LCD panel 100 has a unique structure as illustrated in FIG. 1, the LCD panel 100 may reduce power consumption by applying data signals of a first polarity to odd data-lines and by applying data signals of a second polarity (i.e., opposite to the first polarity) to even data-lines in each frame.

In addition, the LCD panel 100 may reduce or prevent horizontal crosstalk by applying data signals of the same polarity to odd column row-pixels and even column row-pixels with an interval of one horizontal period in a row direction. Further, the LCD panel 100 may reduce or prevent vertical crosstalk by sequentially applying data signals of alternate polarities to column-pixels with an interval of one horizontal period in a column direction.

In one example embodiment, each of the pixels 110 generates one of a red color, a green color, a blue color, etc. In this case, the LCD panel 100 further includes a plurality of red filters, a plurality of green filters, a plurality of blue filters, etc., on the pixels 110. In another example embodiment, each of the pixels 110 generates one of a yellow color, a cyan color, a magenta color, etc. In this case, the LCD panel 100 further includes a plurality of yellow filters, a plurality of cyan filters, a plurality of magenta filters, etc., on the pixels 110. Hence, the LCD panel 100 may display an image by generating various colors in accordance with a space-division method or a time-division method.

Figure 2:
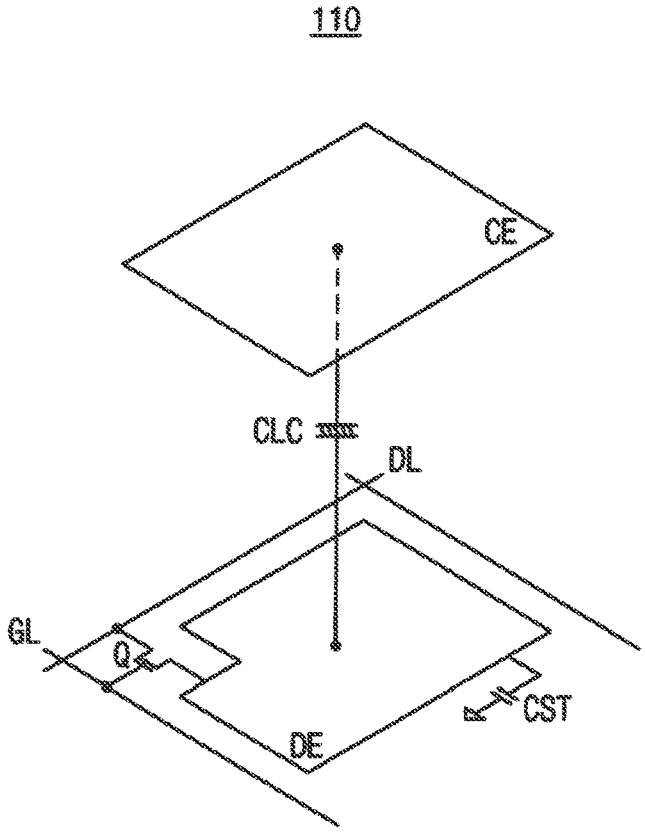
FIG. 2 is a diagram illustrating a structure of each pixel in the LCD panel of FIG. 1.

FIG. 2 is a diagram illustrating a structure of each pixel 110 in the LCD panel 100 of FIG. 1.

Referring to FIG. 2, each of the pixels 110 includes a switching element Q, a liquid crystal capacitor CLC, and a storage capacitor CST. In some example embodiments, the switching element Q may correspond to (for example, be) a thin film transistor (TFT) using amorphous silicon.

In the embodiment of FIG. 2, the switching element Q is placed on a lower display substrate. The switching element Q (e.g., a TFT) provides a data signal to the liquid crystal capacitor CLC in response to a gate signal.

As illustrated in FIG. 2, the gate signal is input from a gate-line GL and the data signal is input from a data-line DL. The switching element Q is coupled to the gate-line GL via its gate terminal, to the data-line DL via its source terminal, and to the liquid crystal capacitor CLC via its drain terminal.

The liquid crystal capacitor CLC is charged by a voltage difference between the data signal and a common voltage. The data signal is applied to a pixel electrode DE of the liquid crystal capacitor CLC. The common voltage is applied to a common electrode CE of the liquid crystal capacitor CLC.

As described above, a liquid crystal layer is placed between the pixel electrode DE and the common electrode CE. Hence, the light transmittance of the liquid crystal layer is controlled by an intensity of the electric field formed between the pixel electrode DE and the common electrode CE. This electric field intensity is also referred to as a charged voltage.

In case of a normally black mode, for example, the light transmittance of the liquid crystal layer may increase as the intensity of the electric field formed between the pixel electrode DE and the common electrode CE increases. On the other hand, the light transmittance of the liquid crystal layer may decrease as the intensity of the electric field formed between the pixel electrode DE and the common electrode CE decreases.

In some example embodiments, the liquid crystal capacitor CLC includes the pixel electrode DE formed on the lower display substrate, the common electrode CE formed on an upper display substrate, and the liquid crystal layer placed between the pixel electrode DE and the common electrode CE. However, the structure of the liquid crystal capacitor CLC is not limited thereto.

For example, the common electrode CE of the liquid crystal capacitor CLC may be formed on the lower display substrate. In this case, the common electrode CE may receive the common voltage from a signal line formed on the lower display substrate. In addition, the pixel electrode DE is coupled to the drain terminal of the switching element Q so that the pixel electrode DE receives the data signal from the data-line DL coupled to the source terminal of the switching element Q.

In one example embodiment, a low common voltage is applied to the pixels 110 when a data signal of positive polarity is applied to the pixels 110. On the other hand, a high common voltage is applied to the pixels 110 when a data signal of negative polarity is applied to the pixels 110. As a result, the charged voltage (i.e., the intensity of the electric field formed between the pixel electrode DE and the common electrode CE) is greater than a voltage level of the data signal so that power consumption may be substantially reduced.

The storage capacitor CST maintains the charged voltage of the liquid crystal capacitor CLC. That is, the storage capacitor CST assists the liquid crystal capacitor CLC. The storage capacitor CST may be formed by placing an insulator between the pixel electrode DE and the signal line.

In some example embodiments, the pixels 110 do not include the storage capacitor CST. The color filters may be arranged on the upper display substrate. Polarizing plates may be attached to the upper display substrate and/or the lower display substrate.

Figure 3:
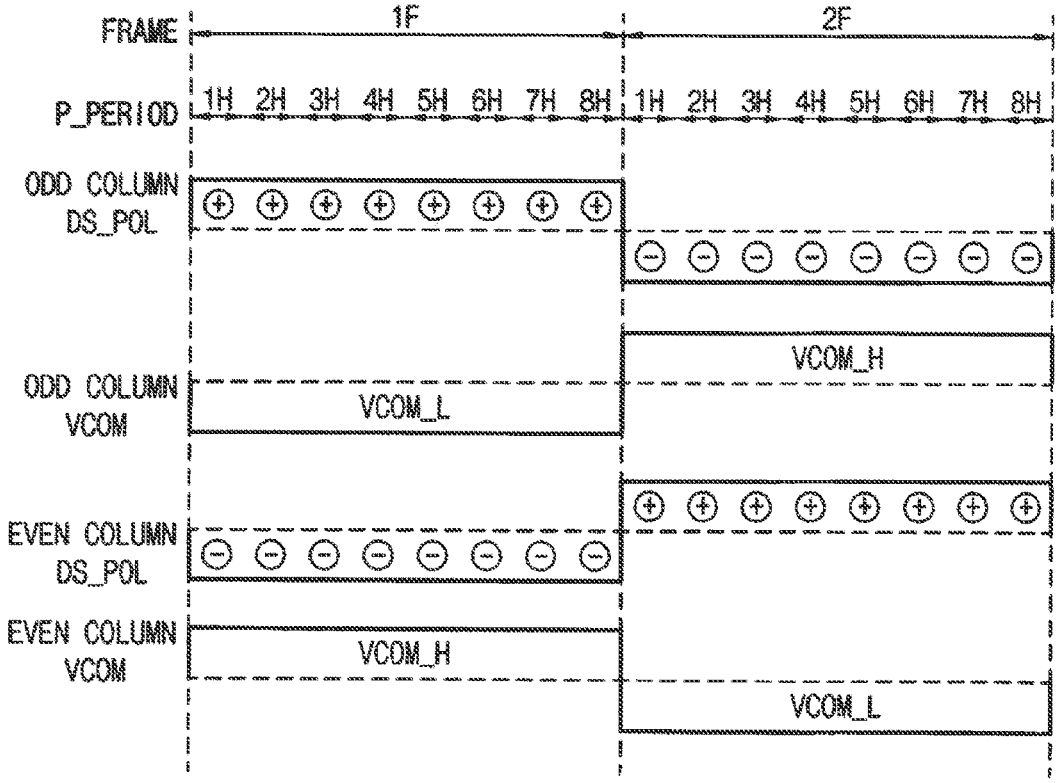
FIG. 3 is a timing diagram illustrating an example of providing common voltages in accordance with polarities of data signals provided to the LCD panel of FIG. 1.

FIG. 3 is a timing diagram illustrating an example of providing common voltages in accordance with polarities of data signals provided to the LCD panel 100 of FIG. 1.

Referring to FIG. 3, a frame (i.e., a first frame 1F and a second frame 2F following the first frame 1F) includes a plurality of horizontal periods 1H through 8H. For ease of illustration, in each of the exemplary frames 1F and 2F of FIG. 3, eight horizontal periods are shown and described. However, the frame may contain another number of horizontal periods without departing from the spirit or scope of the present invention. Here, the first frame 1F corresponds to an odd frame and the second frame 2F corresponds to an even frame. As described above, the LCD panel 100 displays an image in a frame unit. Hence, the LCD panel 100 generates an image by sequentially displaying a plurality of frames.

The first frame 1F includes eight horizontal periods 1H through 8H. When gate signals (i.e., a scan pulse) are applied to the first sub gate-line 120_1, the gate-lines 130_1 through 130_*k*, and the second sub gate-line 120_2 in the first frame 1F, data signals output from the odd data-lines 140_1 through 140_5 and the even data-lines 150_1 through 150_5 are applied to odd column row-pixels and even column row-pixels, as illustrated in FIG. 1.

Here, a low common voltage VCOM_L is applied to the pixels 110 when data signals of positive polarity are applied to the pixels 110. On the other hand, a high common voltage VCOM_H is applied to the pixels 110 when data signals of negative polarity are applied to the pixels 110.

In detail, when data signals of positive polarity are applied to the odd data-lines 140_1 through 140_5 in the first frame 1F, the low common voltage VCOM_L is applied to the common electrodes of the pixels 110 coupled to the odd data-lines 140_1 through 140_5 (that is, the pixels in even rows, as illustrated in the LCD panel 100 of FIG. 1). On the other hand, when data signals of negative polarity are applied to the even data-lines 150_1 through 150_5 in the first frame 1F, the high common voltage VCOM_H is applied to the common electrodes of the pixels 110 coupled to the even data-lines 150_1 through 150_5 (that is, the pixels in odd rows, as illustrated in FIG. 1).

Similarly, when data signals of negative polarity are applied to the odd data-lines 140_1 through 140_5 in the second frame 2F, the high common voltage VCOM_H is applied to the common electrodes of the pixels 110 coupled to the odd data-lines 140_1 through 140_5 (the pixels in even rows). On the other hand, when data signals of positive polarity are applied to the even data-lines 150_1 through 150_5 in the second frame 2F, the low common voltage VCOM_L is applied to the common electrodes of the pixels 110 coupled to the even data-lines 150_1 through 150_5 (the pixels in odd rows).

Therefore, charged voltages of the liquid crystal capacitors CLC in the pixels 110 may be greater than voltage levels of data signals provided to the pixels 110. As described above, the LCD panel 100 may substantially receive the low common voltage VCOM_L and the high common voltage VCOM_H in a similar way to the ALS inversion method (i.e., common voltages applied to the odd data-lines 140_1 through 140_5 and the even data-lines 150_1 through 150_5 may be inverted with each frame). Thus, power consumption of the LCD panel 100 may be reduced compared to the earlier described inversion methods.

FIG. 4 is a diagram illustrating an example of providing data signals to the LCD panel 100 of FIG. 1 in an odd frame 1F.

Referring to FIG. 4, when an LCD device provides data signals to the data-lines DL1 through DL8 of the LCD panel 100 in the odd frame 1F, the LCD device provides data signals of a first polarity (e.g., positive polarity) to the odd data-lines 140_1 through 140_4 and provides data signals of a second polarity (e.g., negative polarity) to the even data-lines 150_1 through 150_4. In FIG. 4, for ease of illustration, the first eight data lines DL1 through DL8 (corresponding to odd data-lines 140_1 through 140_4 and even data lines 150_1 through 150_4) and the first eight horizontal periods 1H through 8H are shown and described. However, there may be another number of data lines and horizontal periods without departing from the spirit or scope of the present invention.

In other words, the data-lines DL1 through DL8 are divided into the odd data-lines 140_1 through 140_4 and the even data-lines 150_1 through 150_4 in terms of operations. For example, in the odd frame 1F, the LCD device provides data signals of positive polarity to the odd data-lines 140_1 through 140_4 and provides data signals of negative polarity to the even data-lines 150_1 through 150_4.

As described above, the LCD device inverts polarities of data signals with each frame. Therefore, in the even frame 2F following the odd frame 1F, the LCD device provides data signals of negative polarity to the odd data-lines 140_1 through 140_4 and provides data signals of positive polarity to the even data-lines 150_1 through 150_4.

However, a polarity pattern as displayed on the LCD panel 100 may be different from a polarity pattern as applied to the data-lines DL1 through DL8. Here, a driver polarity pattern indicates the polarity pattern as applied to the data-lines DL1 through DL8 (for example, odd data-lines receiving data signals of positive polarity and even data-lines receiving data signals of negative polarity), and an apparent polarity pattern indicates the polarity pattern as displayed on the LCD panel 100 (for example, pixels in odd rows receiving data signals of negative polarity and pixels in even rows receiving data signals of positive polarity, which is both rotated and inverted from the driver polarity pattern shown in FIG. 4).

For example, a driver polarity pattern of the embodiment of the present invention shown in FIGS. 3 (odd frame 1F) and 4 is similar to a driver polarity pattern of the column inversion method (as illustrated in FIG. 4). On the other hand, because of the characteristics of this embodiment of the present invention, namely that data signals are applied to odd column row-pixels and even column row-pixels with an interval of one horizontal period in a row direction, an apparent polarity pattern of the embodiment of FIGS. 3 (odd frame 1F) and 4 of the present invention is similar to an apparent polarity pattern of the ALS inversion method and the line inversion method (as illustrated in FIGS. 5A through 5E).

FIGS. 5A through 5E are diagrams illustrating an example of applying data signals to pixels of the LCD panel 100 of FIG. 1 in a first five horizontal periods 1H through 5H, respectively, of an odd frame 1F.

Figure 5A:
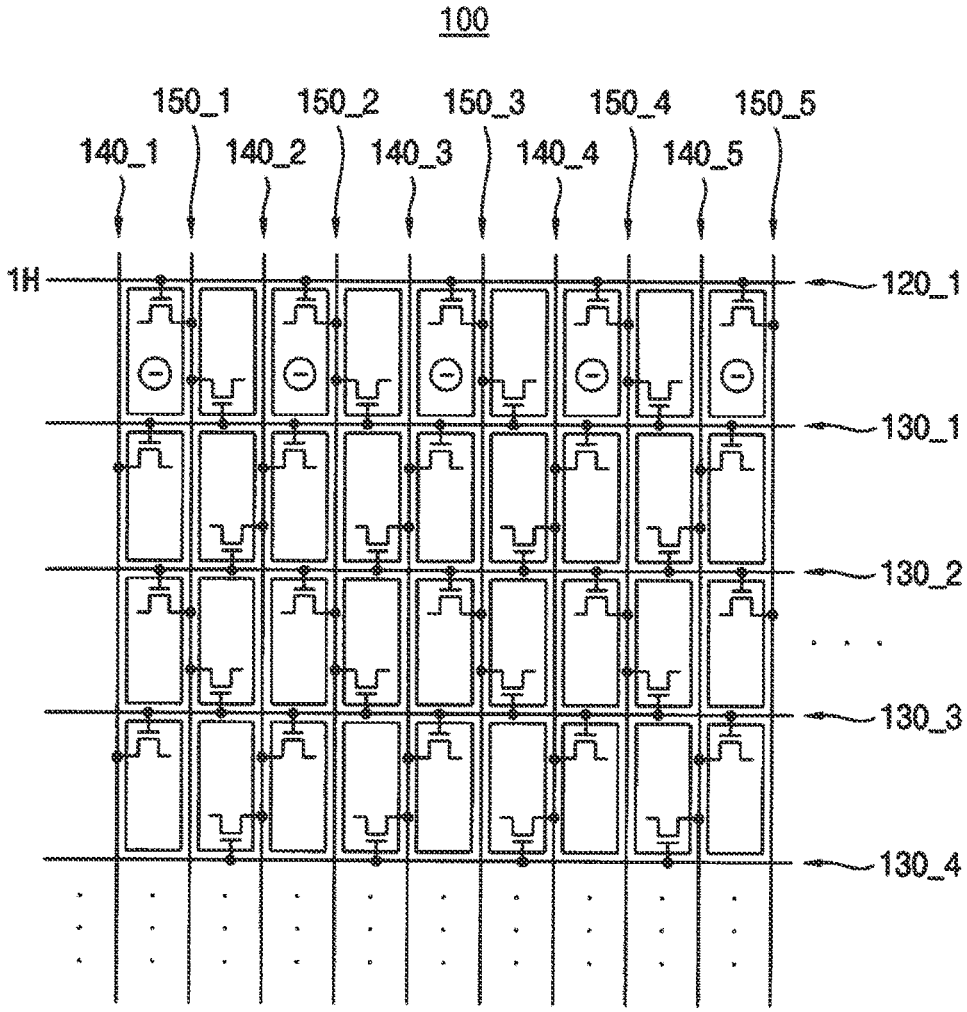
FIGS. 5A through 5E are diagrams illustrating an example of applying data signals to pixels of the LCD panel of FIG. 1 in a first five horizontal periods of an odd frame.

Referring to FIG. 5A, a gate signal for turning on TFTs of the pixels 110 coupled to the first sub gate-line 120_1 is provided during a first horizontal period 1H. Since the first sub gate-line 120_1 is coupled to odd column row-pixels among the pixels 110 that constitute a first row, data signals are applied to the odd column row-pixels among the pixels 110 that constitute the first row.

As illustrated in FIG. 5A, the odd column row-pixels among the pixels 110 that constitute the first row are coupled to the even data-lines 150_1 through 150_5. In the odd frame 1F, data signals applied to the even data-lines 150_1 through 150_5 have negative polarity. Thus, the odd column row-pixels among the pixels 110 that constitute the first row receive data signals of negative polarity during the first horizontal period 1H. As a result, horizontal crosstalk may be reduced or prevented because data signals of the same polarity are not applied to adjacent row-pixels at the same time during the first horizontal period 1H.

Figure 5B:
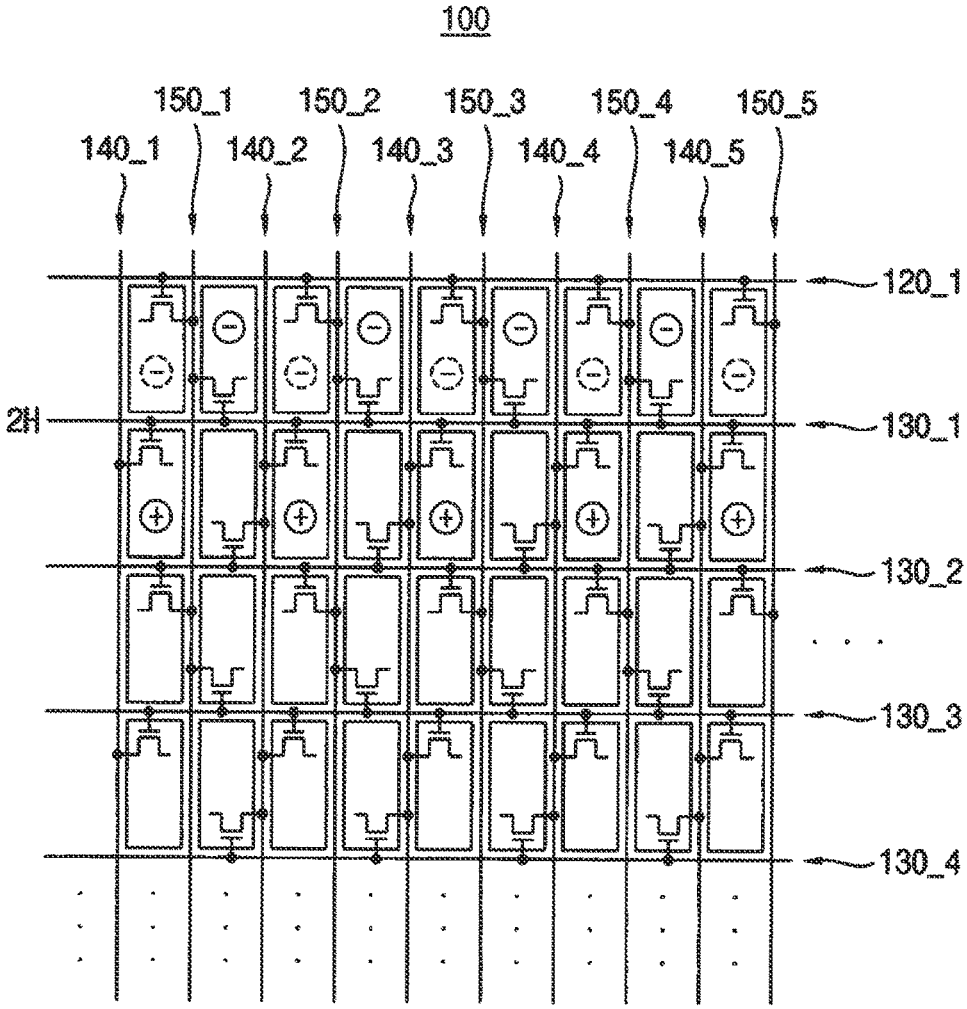

Referring to FIG. 5B, a gate signal for turning on TFTs of the pixels 110 coupled to the first gate-line 130_1 is provided during a second horizontal period 2H. Since the first gate-line 130_1 is coupled to even column row-pixels among the pixels 110 that constitute the first row and to odd column row-pixels among the pixels 110 that constitute a second row, data signals are applied to the even column row-pixels among the pixels 110 that constitute the first row and to the odd column row-pixels among the pixels 110 that constitute the second row.

As illustrated in FIG. 5B, the even column row-pixels among the pixels 110 that constitute the first row are coupled to the even data-lines 150_1 through 150_4. In the odd frame 1F, data signals applied to the even data-lines 150_1 through 150_4 have negative polarity. Thus, the even column row-pixels among the pixels 110 that constitute the first row receive data signals of negative polarity during the second horizontal period 2H.

Further, as illustrated in FIG. 5B, the odd column row-pixels among the pixels 110 that constitute the second row are coupled to the odd data-lines 140_1 through 140_5. In the odd frame 1F, data signals applied to the odd data-lines 140_1 through 140_5 have positive polarity. Thus, the odd column row-pixels among the pixels 110 that constitute the second row receive data signals of positive polarity during the second horizontal period 2H.

As a result, horizontal crosstalk may be reduced or prevented because data signals of the same polarity are not applied to adjacent row-pixels at the same time during the second horizontal period 2H (that is, adjacent row-pixels receiving data signals of the same polarity do so during different horizontal periods, as illustrated in the first row of pixels in FIG. 5B). Further, vertical crosstalk may be reduced or prevented because data signals of opposite polarities are applied to adjacent column-pixels.

Figure 5C:
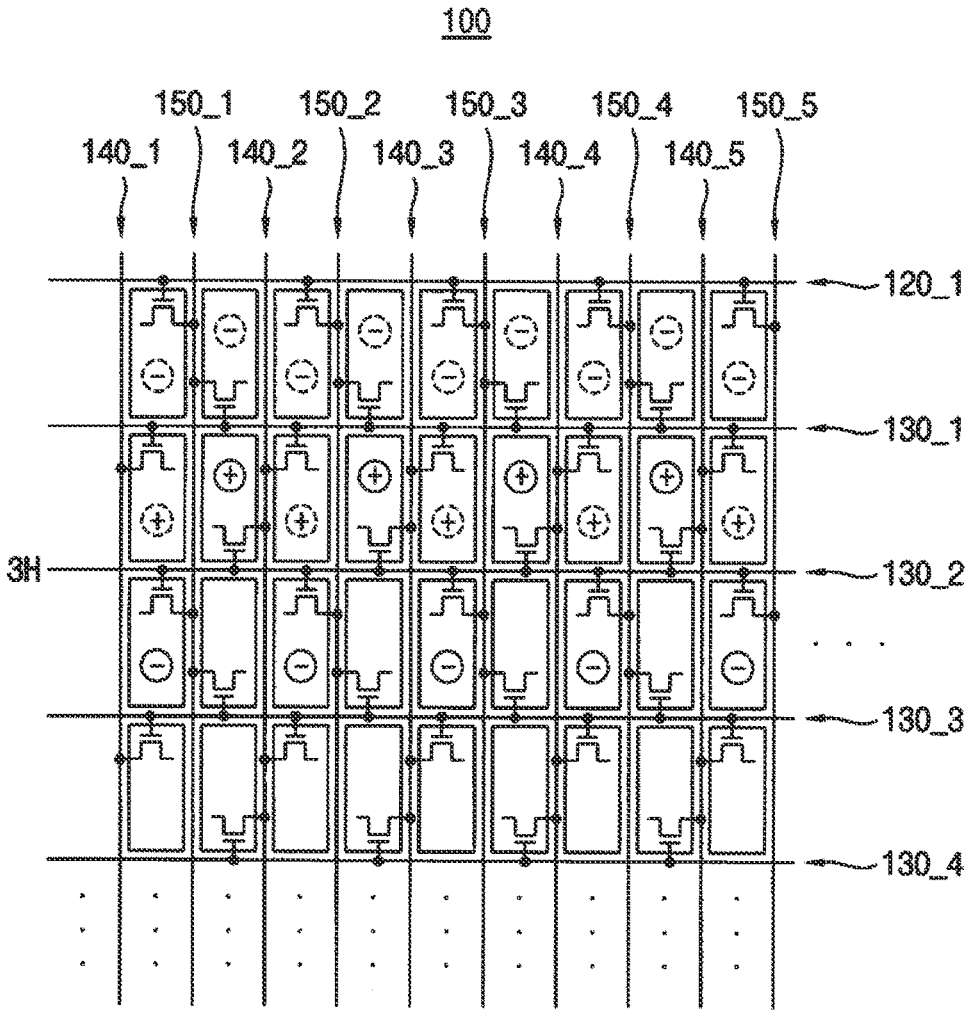

Referring to FIG. 5C, a gate signal for turning on TFTs of the pixels 110 coupled to the second gate-line 130_2 is provided during a third horizontal period 3H. Since the second gate-line 130_2 is coupled to even column row-pixels among the pixels 110 that constitute the second row to and odd column row-pixels among the pixels 110 that constitute a third row, data signals are applied to the even column row-pixels among the pixels 110 that constitute the second row and to the odd column row-pixels among the pixels 110 that constitute the third row.

As illustrated in FIG. 5C, the even column row-pixels among the pixels 110 that constitute the second row are coupled to the odd data-lines 140_2 through 140_5. In the odd frame 1F, data signals applied to the odd data-lines 140_2 through 140_5 have positive polarity. Thus, the even column row-pixels among the pixels 110 that constitute the second row receive data signals of positive polarity during the third horizontal period 3H.

Further, as illustrated in FIG. 5C, the odd column row-pixels among the pixels 110 that constitute the third row are coupled to the even data-lines 150_1 through 150_5. In the odd frame 1F, data signals applied to the even data-lines 150_1 through 150_5 have negative polarity. Thus, the odd column row-pixels among the pixels 110 that constitute the third row receive data signals of negative polarity during the third horizontal period 3H.

As a result, horizontal crosstalk may be reduced or prevented because data signals of the same polarity are not applied to adjacent row-pixels at the same time during the third horizontal period 3H (that is, adjacent row-pixels receiving data signals of the same polarity do so during different horizontal periods, as illustrated in the second row of pixels in FIG. 5C). Further, vertical crosstalk may be reduced or prevented because data signals of opposite polarities are applied to adjacent column-pixels.

Figure 5D:
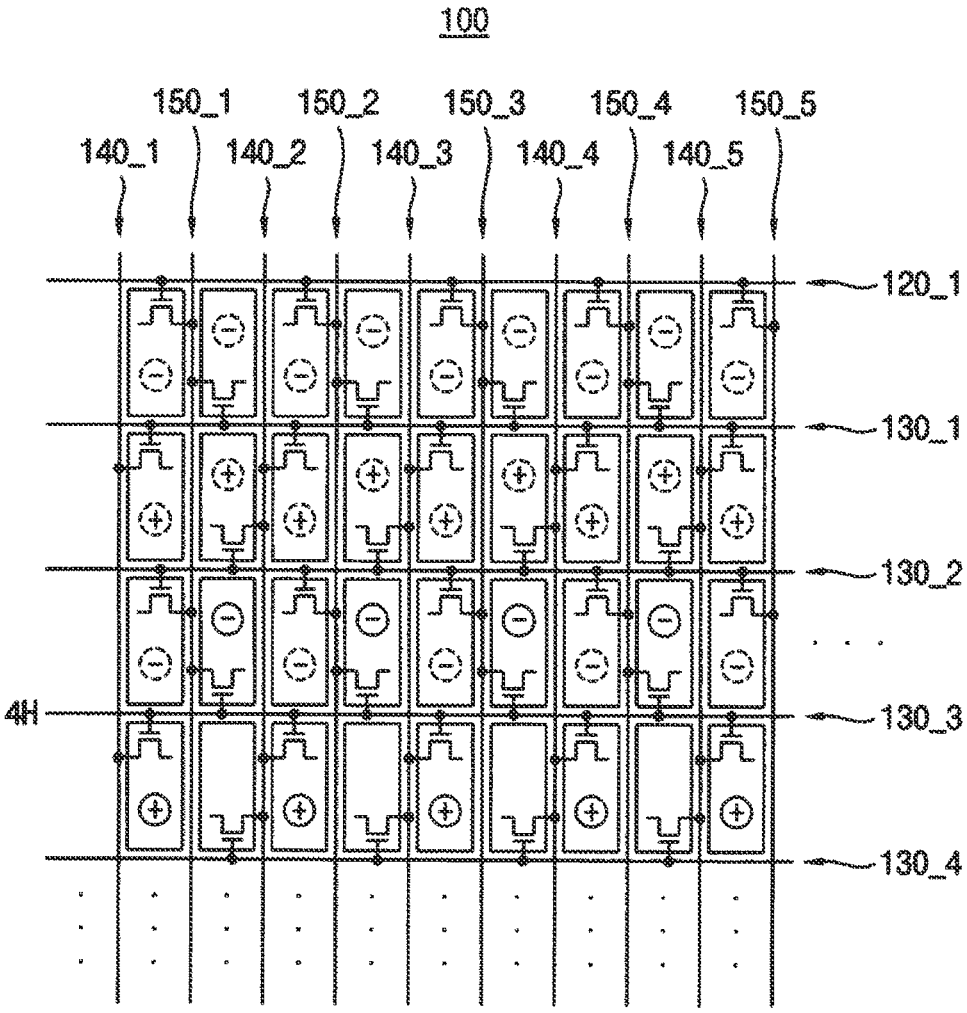

Referring to FIG. 5D, a gate signal for turning on TFTs of the pixels 110 coupled to the third gate-line 130_3 is provided during a fourth horizontal period 4H. Since the third gate-line 130_3 is coupled to even column row-pixels among the pixels 110 that constitute the third row and to odd column row-pixels among the pixels 110 that constitute a fourth row, data signals are applied to the even column row-pixels among the pixels 110 that constitute the third row and to the odd column row-pixels among the pixels 110 that constitute the fourth row.

As illustrated in FIG. 5D, the even column row-pixels among the pixels 110 that constitute the third row are coupled to the even data-lines 150_1 through 150_4. In the odd frame 1F, data signals applied to the even data-lines 150_1 through 150_4 have negative polarity. Thus, the even column row-pixels among the pixels 110 that constitute the third row receive data signals of negative polarity during the fourth horizontal period 4H.

Further, as illustrated in FIG. 5D, the odd column row-pixels among the pixels 110 that constitute the fourth row are coupled to the odd data-lines 140_1 through 140_5. In the odd frame 1F, data signals applied to the odd data-lines 140_1 through 140_5 have positive polarity. Thus, the odd column row-pixels among the pixels 110 that constitute the fourth row receive data signals of positive polarity during the fourth horizontal period 4H.

As a result, horizontal crosstalk may be reduced or prevented because data signals of the same polarity are not applied to adjacent row-pixels at the same time during the fourth horizontal period 4H (that is, adjacent row-pixels receiving data signals of the same polarity do so during different horizontal periods, as illustrated in the third row of pixels in FIG. 5D). Further, vertical crosstalk may be reduced or prevented because data signals of opposite polarities are applied to adjacent column-pixels.

Figure 5E:
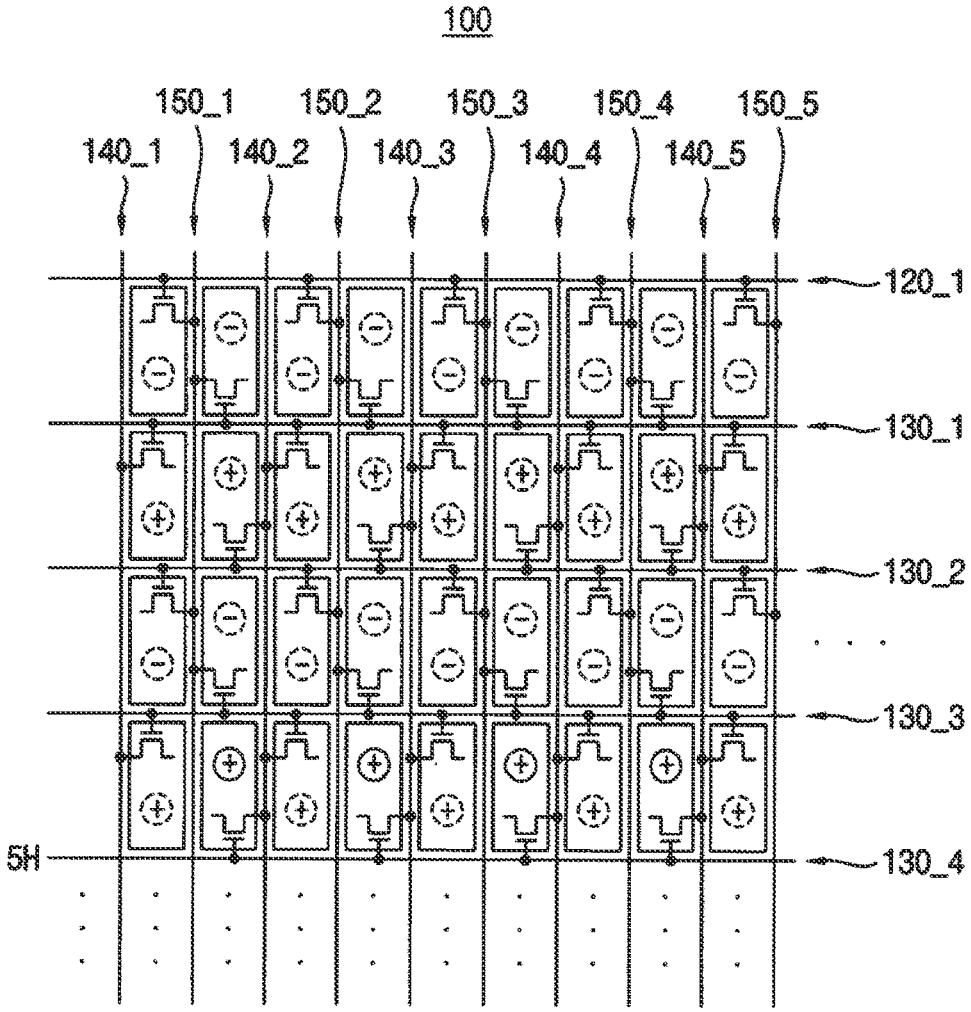

Referring to FIG. 5E, a gate signal for turning on TFTs of the pixels 110 coupled to the fourth gate-line 130_4 is provided during a fifth horizontal period 5H. Since the fourth gate-line 130_4 is coupled to even column row-pixels among the pixels 110 that constitute the fourth row, data signals are applied to the even column row-pixels among the pixels 110 that constitute the fourth row.

As illustrated in FIG. 5E, the even column row-pixels among the pixels 110 that constitute the fourth row are coupled to the odd data-lines 140_2 through 140_5. As described above, even column row-pixels among the pixels 110 that constitute the fourth row receive data signals of positive polarity during the fifth horizontal period 5H of the odd frame 1F. Further, though not specifically illustrated in FIG. 5E, odd column row-pixels among the pixels 110 that constitute a fifth row receive data signals of negative polarity during the fifth horizontal period 5H.

As a result, horizontal crosstalk may be reduced or prevented because data signals of the same polarity are not applied to adjacent row-pixels at the same time during the fifth horizontal period 5H (that is, adjacent row-pixels receiving data signals of the same polarity do so during different horizontal periods, as illustrated in the fourth row of pixels in FIG. 5E). Further, vertical crosstalk may be reduced or prevented because data signals of opposite polarities are applied to adjacent column-pixels.

This process continues until the odd frame 1F is finished by applying a gate signal for turning on TFTs of the pixels 110 coupled to the second sub gate-line 120_2. Then, polarities of data signals are inverted when the LCD device changes a display frame from the odd frame 1F to the even frame 2F. Hence, polarities of data signals in the odd frame 1F are opposite to polarities of data signals in the even frame 2F following the odd frame 1F.

As illustrated in FIGS. 5A through 5E, a driver polarity pattern of the embodiment of the present invention shown in FIGS. 3 (odd frame 1F) and 4 is similar to a driver polarity pattern of the column inversion method (as displayed in FIG. 4). In addition, because of the characteristics of this embodiment of the present invention, namely that data signals are applied to odd column row-pixels and even column row-pixels with an interval of one horizontal period in a row direction, an apparent polarity pattern of the embodiment of FIGS. 3 (odd frame 1F) and 4 of the present invention is similar to an apparent polarity pattern of the ALS inversion method and the line inversion method.

FIG. 6 is a diagram illustrating an example of providing data signals to the LCD panel 100 of FIG. 1 in an even frame 2F.

Referring to FIG. 6, when an LCD device provides data signals to the data-lines DL1 through DL8 of the LCD panel 100 in the even frame 2F, the LCD device provides data signals of a second polarity (e.g., negative polarity) to the odd data-lines 140_1 through 140_4 and provides data signals of a first polarity (e.g., positive polarity) to the even data-lines 150_1 through 150_4. In FIG. 6, for ease of illustration, the first eight data lines DL1 through DL8 (corresponding to odd data-lines 140_1 through 140_4 and even data lines 150_1 through 150_4) and the first eight horizontal periods 1H through 8H are shown and described. However, there may be another number of data lines and horizontal periods without departing from the spirit or scope of the present invention.

In other words, the data-lines DL1 through DL8 are divided into the odd data-lines 140_1 through 140_4 and the even data-lines 150_1 through 150_4 in terms of operations. For example, in the even frame 2F, the LCD device provides data signals of negative polarity to the odd data-lines 140_1 through 140_4 and provides data signals of positive polarity to the even data-lines 150_1 through 150_4.

As described above, the LCD device inverts polarities of data signals with each frame. Therefore, in the first frame 1F following the second frame 2F, the LCD device provides data signals of positive polarity to the odd data-lines 140_1 through 140_4 and provides data signals of negative polarity to the even data-lines 150_1 through 150_4.

However, a polarity pattern as displayed on the LCD panel 100 may be different from a polarity pattern as applied to the data-lines DL1 through DL8. Here, a driver polarity pattern indicates the polarity pattern as applied to the data-lines DL1 through DL8 (for example, odd data-lines receiving data signals of negative polarity and even data-lines receiving data signals of positive polarity), and an apparent polarity pattern indicates the polarity pattern as displayed on the LCD panel 100 (for example, pixels in odd rows receiving data signals of positive polarity and pixels in even rows receiving data signals of negative polarity, which is both rotated and inverted from the driver polarity pattern shown in FIG. 6).

For example, a driver polarity pattern of an embodiment of the present invention shown in FIGS. 3 (even frame 2F) and 6 is similar to a driver polarity pattern of the column inversion method (as illustrated in FIG. 6). On the other hand, because of the characteristics of this embodiment of the present invention, namely that data signals are applied to odd column row-pixels and even column row-pixels with an interval of one horizontal period in a row direction, an apparent polarity pattern of the embodiment of FIGS. 3 (even frame 2F) and 6 of the present invention is similar to an apparent polarity pattern of the ALS inversion method and the line inversion method (as illustrated in FIGS. 7A through 7E).

FIGS. 7A through 7E are diagrams illustrating an example of applying data signals to pixels of the LCD panel 100 of FIG. 1 in a first five horizontal periods 1H through 5H, respectively, of an even frame 2F.

Figure 7A:
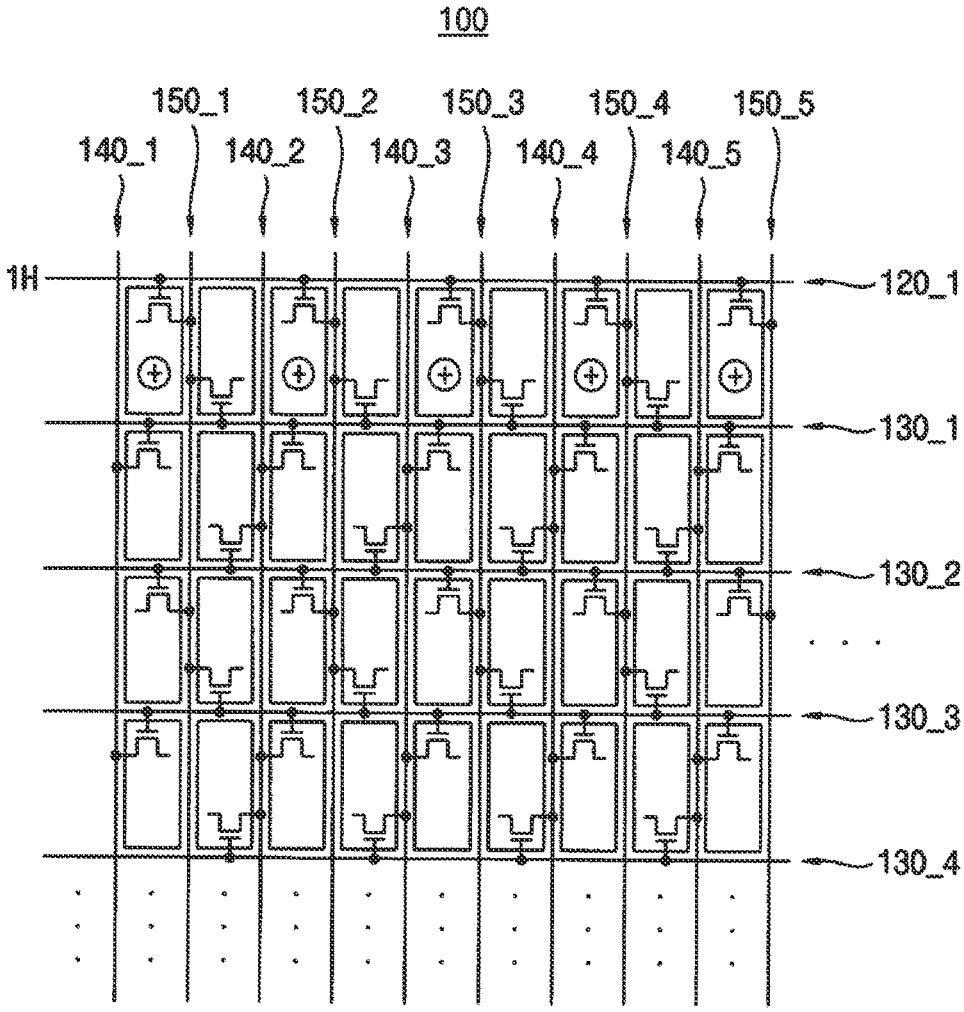
FIGS. 7A through 7E are diagrams illustrating an example of applying data signals to pixels of the LCD panel of FIG. 1 in a first five horizontal periods of an even frame.

Referring to FIG. 7A, a gate signal for turning on TFTs of the pixels 110 coupled to the first sub gate-line 120_1 is provided during a first horizontal period 1H. Since the first sub gate-line 120_1 is coupled to odd column row-pixels among the pixels 110 that constitute a first row, data signals are applied to the odd column row-pixels among the pixels 110 that constitute the first row.

As illustrated in FIG. 7A, the odd column row-pixels among the pixels 110 that constitute the first row are coupled to the even data-lines 150_1 through 150_5. In the even frame 2F, data signals applied to the even data-lines 150_1 through 150_5 have positive polarity. Thus, the odd column row-pixels among the pixels 110 that constitute the first row receive data signals of positive polarity during the first horizontal period 1H. As a result, horizontal crosstalk may be reduced or prevented because data signals of the same polarity are not applied to adjacent row-pixels at the same time during the first horizontal period 1H.

Figure 7B:
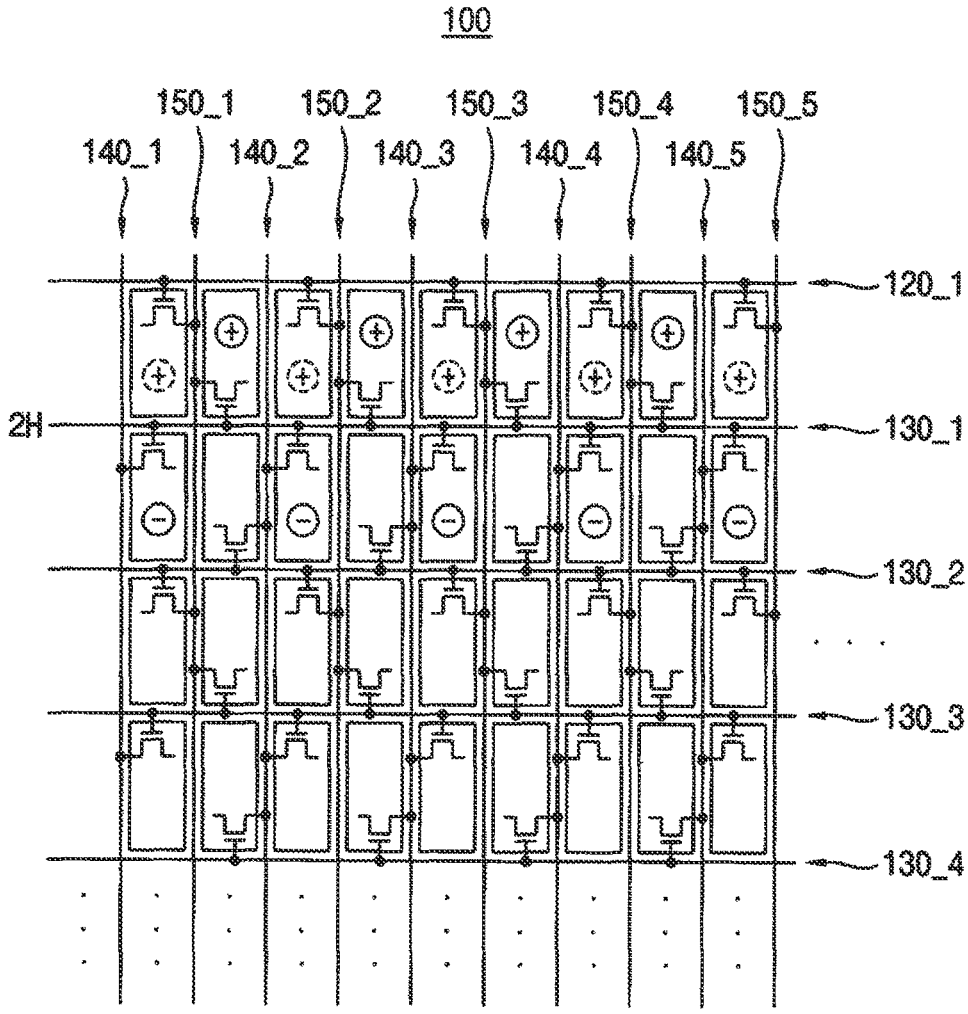

Referring to FIG. 7B, a gate signal for turning on TFTs of the pixels 110 coupled to the first gate-line 130_1 is provided during a second horizontal period 2H. Since the first gate-line 130_1 is coupled to even column row-pixels among the pixels 110 that constitute the first row and to odd column row-pixels among the pixels 110 that constitute a second row, data signals are applied to the even column row-pixels among the pixels 110 that constitute the first row and to the odd column row-pixels among the pixels 110 that constitute the second row.

As illustrated in FIG. 7B, the even column row-pixels among the pixels 110 that constitute the first row are coupled to the even data-lines 150_1 through 150_4. In the even frame 2F, data signals applied to the even data-lines 150_1 through 150_4 have positive polarity. Thus, the even column row-pixels among the pixels 110 that constitute the first row receive data signals of positive polarity during the second horizontal period 2H.

Further, as illustrated in FIG. 7B, the odd column row-pixels among the pixels 110 that constitute the second row are coupled to the odd data-lines 140_1 through 140_5. In the even frame 2F, data signals applied to the odd data-lines 140_1 through 140_5 have negative polarity. Thus, the odd column row-pixels among the pixels 110 that constitute the second row receive data signals of negative polarity during the second horizontal period 2H.

As a result, horizontal crosstalk may be reduced or prevented because data signals of the same polarity are not applied to adjacent row-pixels at the same time during the second horizontal period 2H (that is, adjacent row-pixels receiving data signals of the same polarity do so during different horizontal periods, as illustrated in the first row of pixels in FIG. 7B). Further, vertical crosstalk may be reduced or prevented because data signals of opposite polarities are applied to adjacent column-pixels.

Figure 7C:
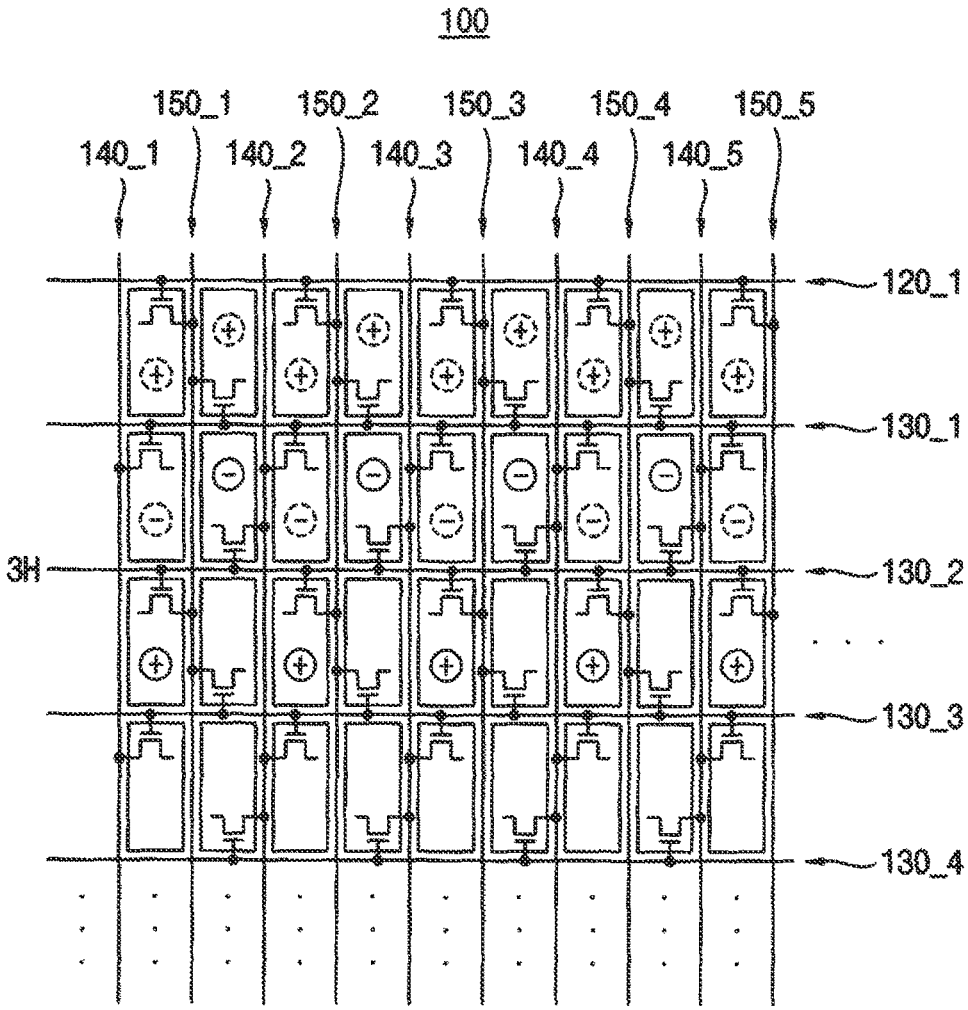

Referring to FIG. 7C, a gate signal for turning on TFTs of the pixels 110 coupled to the second gate-line 130_2 is provided during a third horizontal period 3H. Since the second gate-line 130_2 is coupled to even column row-pixels among the pixels 110 that constitute the second row and to odd column row-pixels among the pixels 110 that constitute a third row, data signals are applied to the even column row-pixels among the pixels 110 that constitute the second row and to the odd column row-pixels among the pixels 110 that constitute the third row.

As illustrated in FIG. 7C, the even column row-pixels among the pixels 110 that constitute the second row are coupled to the odd data-lines 140_2 through 140_5. In the even frame 2F, data signals applied to the odd data-lines 140_2 through 140_5 have negative polarity. Thus, the even column row-pixels among the pixels 110 that constitute the second row receive data signals of negative polarity during the third horizontal period 3H.

Further, as illustrated in FIG. 7C, the odd column row-pixels among the pixels 110 that constitute the third row are coupled to the even data-lines 150_1 through 150_5. In the even frame 2F, data signals applied to the even data-lines 150_1 through 150_5 have positive polarity. Thus, the odd column row-pixels among the pixels 110 that constitute the third row receive data signals of positive polarity during the third horizontal period 3H.

As a result, horizontal crosstalk may be reduced or prevented because data signals of the same polarity are not applied to adjacent row-pixels at the same time during the third horizontal period 3H (that is, adjacent row-pixels receiving data signals of the same polarity do so during different horizontal periods, as illustrated in the second row of pixels in FIG. 7C). Further, vertical crosstalk may be reduced or prevented because data signals of opposite polarities are applied to adjacent column-pixels.

Figure 7D:
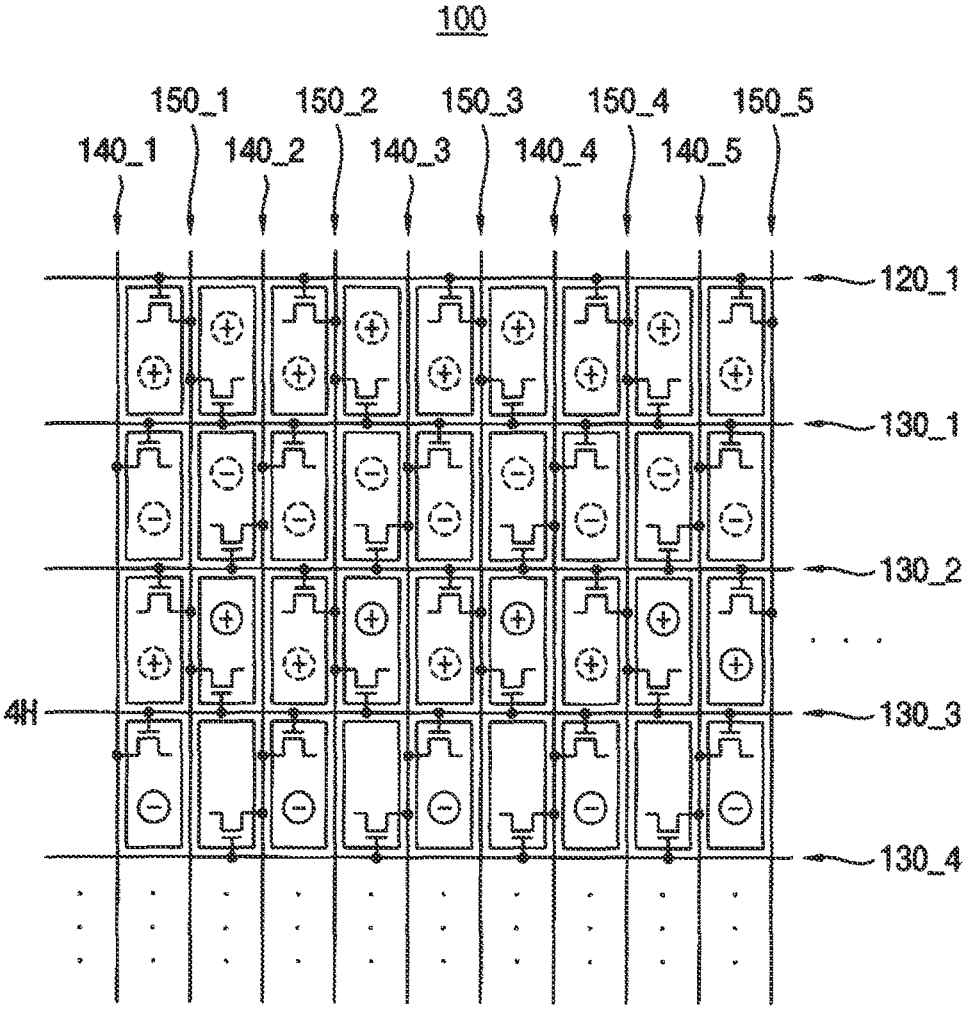

Referring to FIG. 7D, a gate signal for turning on TFTs of the pixels 110 coupled to the third gate-line 130_3 is provided during a fourth horizontal period 4H. Since the third gate-line 130_3 is coupled to even column row-pixels among the pixels 110 that constitute the third row and to odd column row-pixels among the pixels 110 that constitute a fourth row, data signals are applied to the even column row-pixels among the pixels 110 that constitute the third row and to the odd column row-pixels among the pixels 110 that constitute the fourth row.

As illustrated in FIG. 7D, the even column row-pixels among the pixels 110 that constitute the third row are coupled to the even data-lines 150_1 through 150_4. In the even frame 2F, data signals applied to the even data-lines 150_1 through 150_4 have positive polarity. Thus, the even column row-pixels among the pixels 110 that constitute the third row receive data signals of positive polarity during the fourth horizontal period 4H.

Further, as illustrated in FIG. 7D, the odd column row-pixels among the pixels 110 that constitute the fourth row are coupled to the odd data-lines 140_1 through 140_5. In the even frame 2F, data signals applied to the odd data-lines 140_1 through 140_5 have negative polarity. Thus, the odd column row-pixels among the pixels 110 that constitute the fourth row receive data signals of negative polarity during the fourth horizontal period 4H.

As a result, horizontal crosstalk may be reduced or prevented because data signals of the same polarity are not applied to adjacent row-pixels at the same time during the fourth horizontal period 4H (that is, adjacent row-pixels receiving data signals of the same polarity do so during different horizontal periods, as illustrated in the third row of pixels in FIG. 7D). Further, vertical crosstalk may be reduced or prevented because data signals of opposite polarities are applied to adjacent column-pixels.

Figure 7E:
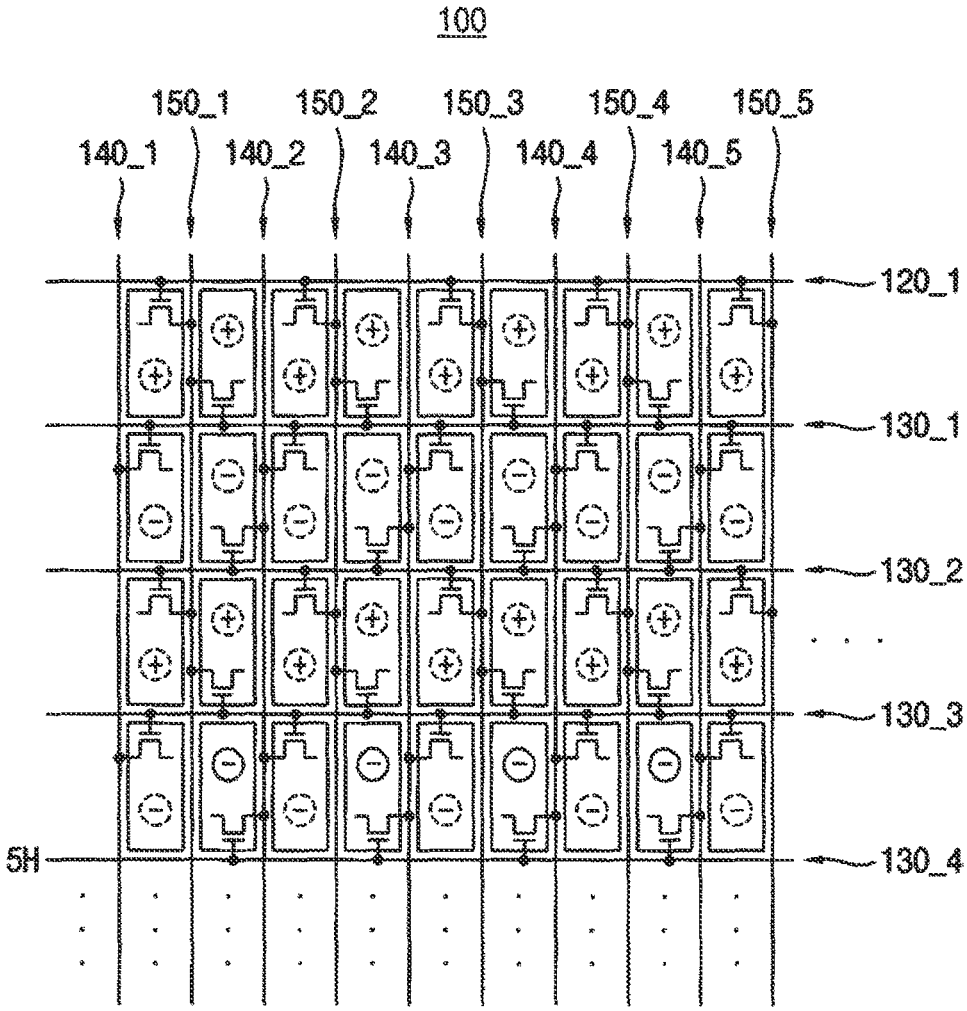

Referring to FIG. 7E, a gate signal for turning on TFTs of the pixels 110 coupled to the fourth gate-line 1304 is provided during a fifth horizontal period 5H. Since the fourth gate-line 130_4 is coupled to even column row-pixels among the pixels 110 that constitute the fourth row, data signals are applied to the even column row-pixels among the pixels 110 that constitute the fourth row.

As illustrated in FIG. 7E, the even column row-pixels among the pixels 110 that constitute the fourth row are coupled to the odd data-lines 140_2 through 140_5. As described above, even column row-pixels among the pixels 110 that constitute the fourth row receive data signals of negative polarity during the fifth horizontal period 5H of the even frame 2F. Further, though not specifically illustrated in FIG. 5E, odd column row-pixels among the pixels 110 that constitute a fifth row receive data signals of positive polarity during the fifth horizontal period 5H.

As a result, horizontal crosstalk may be reduced or prevented because data signals of the same polarity are not applied to adjacent row-pixels at the same time during the fifth horizontal period 5H (that is, adjacent row-pixels receiving data signals of the same polarity do so during different horizontal periods, as illustrated in the fourth row of pixels in FIG. 7E). Further, vertical crosstalk may be reduced or prevented because data signals of opposite polarities are applied to adjacent column-pixels.

This process continues until the even frame 2F is finished by applying a gate signal for turning on TFTs of the pixels 110 coupled to the second sub gate-line 120_2. Then, polarities of data signals are inverted when the LCD device changes a display frame from the even frame 2F to the odd frame 1F. Hence, polarities of data signals in the even frame 2F are opposite to polarities of data signals in the odd frame 1F following the even frame 2F.

As illustrated in FIGS. 7A through 7E, a driver polarity pattern of the embodiment of the present invention shown in FIGS. 3 (even frame 2F) and 6 is similar to a driver polarity pattern of the column inversion method (as displayed in FIG. 6). In addition, because of the characteristics of this embodiment of the present invention, namely that data signals are applied to odd column row-pixels and even column row-pixels with an interval of one horizontal period in a row direction, an apparent polarity pattern of the embodiment of FIGS. 3 (even frame 2F) and 6 of the present invention is similar to an apparent polarity pattern of the ALS inversion method and the line inversion method.

Figure 8:
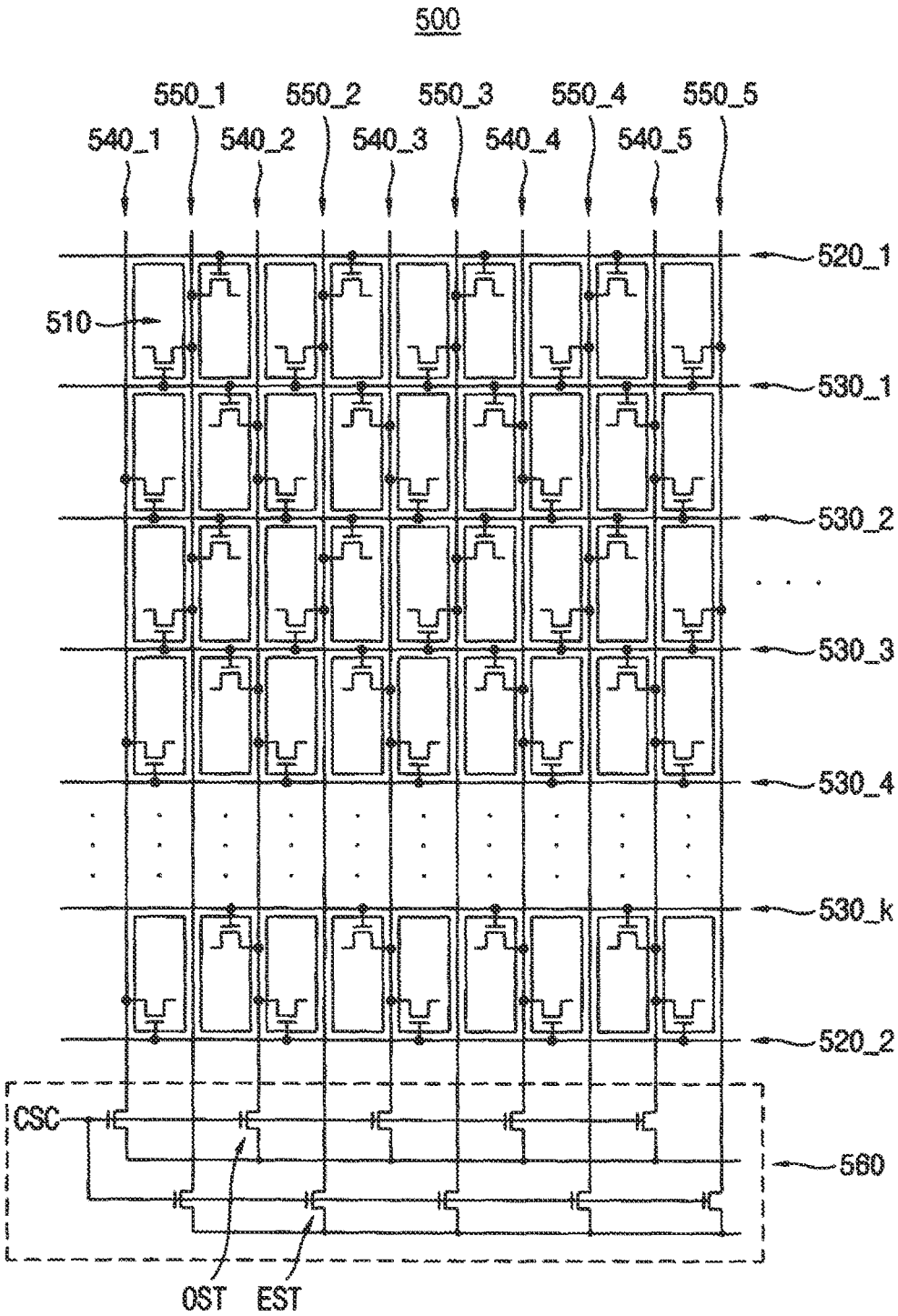
FIG. 8 is a diagram illustrating another LCD panel in accordance with example embodiments.

FIG. 8 is a diagram illustrating another LCD panel 500 in accordance with example embodiments.

Referring to FIG. 8, the LCD panel 500 includes a plurality of pixels 510, a first sub gate-line 520_1, a second sub gate-line 520_2, a plurality of gate-lines 530_1 through 530_*k*, a plurality of odd data-lines 540_1 through 540_5, and a plurality of even data-lines 550_1 through 550_5. The first sub gate-line 520_1, the second sub gate-line 520_2, and the plurality of gate-lines 530_1 through 530_*k* are collectively referred to as row-lines. According to some example embodiments, the LCD panel 500 further includes a charge-sharing control circuit 560. In the embodiment of FIG. 8, for ease of illustration, five odd data lines 540_1 through 540_5 and five even data lines 550_1 through 550_5 are shown and described. However, the LCD panel 500 may contain another number of data lines without departing from the spirit or scope of the present invention.

The pixels 510 are arranged in a matrix manner (that is, in rows and columns) at portions corresponding to crossing regions of the first sub gate-line 520_1, the second sub gate-line 520_2, the gate-lines 530_1 through 530_*k*, the odd data-lines 540_1 through 540_5, and the even data-lines 550_1 through 550_5. Here, each of the pixels 510 is coupled to the first sub gate-line 520_1, the second sub gate-line 520_2, or one of the gate-lines 530_1 through 530_*k* via a gate terminal of its switching element (e.g., a TFT). Additionally, each of the pixels 510 is coupled to one of the odd data-lines 540_1 through 540_5 or one of the even data-lines 550_1 through 550_5 via a source terminal of its switching element (e.g., a TFT). As a result, each of the pixels 510 receives a gate signal (i.e., a scan pulse) output from the first sub gate-line 520_1, the second sub gate-line 520_2, or one of the gate-fines 530_1 through 530_*k* via the gate terminal of its switching element (e.g., a TFT) and receives a data signal output from one of the odd data-lines 540_1 through 540_5 or one of the even data-lines 550_1 through 550_5 via the source terminal of its switching element (e.g., a TFT).

In the embodiment of FIG. 8, the first sub gate-line 520_1 and the second sub gate-line 520_2 are placed at peripheries of the display area, with the gate-lines 530_1 through 530_*k* therebetween. In one example embodiment, the first sub gate-line 520_1 is coupled to first row-pixels (for example, even column row-pixels) that are adjacent to a lower side of the first sub gate-line 520_1. Likewise, the second sub gate-line 520_2 is coupled to second row-pixels (for example, odd column row-pixels) that are adjacent to an upper side of the second sub gate-line 520_2.

The gate-lines 530_1 through 530_*k* are located (for example, placed) between the first sub gate-line 520_1 and the second sub gate-line 520_2. Further, each gate-line of the gate-lines 530_1 through 530_*k* is coupled to second row-pixels that are adjacent to an upper side of the gate-line and to first row-pixels that are adjacent to a lower side of the gate-line.

In other words, each gate-line of the gate-lines 530_1 through 530_*k* is coupled to the pixels 510 in zigzag fashion proceeding in the row direction along the gate-line (that is, the gate-line is alternately coupled to a pixel 110 above the gate-line and to a pixel 110 below the gate-line). Here, as described above, first row-pixels correspond to (for example, are or include) even column row-pixels and second row-pixels correspond to (for example, are or include) odd column row-pixels.

That is, the first sub gate-line 520_1 is coupled to even column row-pixels that are adjacent to a lower side of the first sub gate-line 520_1, the second sub gate-line 520_2 is coupled to odd column row-pixels that are adjacent to an upper side of the second sub gate-line 520_2, and each gate-line of the gate-lines 530_1 through 530_*k* is coupled to odd column row-pixels that are adjacent to an upper side of the gate-line and even column row-pixels that are adjacent to a lower side of the gate-line.

In the embodiment of FIG. 8, the pixels 510 coupled to the odd data-lines 540_1 through 540_5 are different from the pixels 510 coupled to the even data-lines 550_1 through 550_5. In other words, when the odd data-lines 540_1 through 540_5 are coupled to second column-pixels, then the even data-lines 550_1 through 550_5 are coupled to first column-pixels. Here, "column-pixels" describe a plurality of pixels that are common to one column, including a subset of the pixels of one column. For example, in one embodiment, first column-pixels correspond to (for example, are or include) odd row column-pixels and second column-pixels correspond to (for example, are or include) even row column-pixels.

In other embodiments, first column-pixels correspond to (for example, are or include) even row column-pixels while second column-pixels correspond to (for example, are or include) odd row column-pixels. In FIG. 8, it is illustrated that the odd data-lines 540_1 through 540_5 are coupled to even row column-pixels and that the even data-lines 550_1 through 550_5 are coupled to odd row column-pixels.

As described above, each of the pixels 510 is coupled to the first sub gate-line 520_1, the second sub gate-line 520_2, or one of the gate-lines 530_1 through 530_*k* via a gate terminal of its switching element (e.g., a TFT). In addition, each of the pixels 510 is coupled to one of the odd data-lines 540_1 through 540_5 or one of the even data-lines 550_1 through 550_5 via a source terminal of its switching element (e.g., a TFT).

In each frame, data signals of a first polarity are applied to the odd data-lines 540_1 through 540_5 and data signals of a second polarity (i.e., opposite to the first polarity) are applied to the even data-lines 550_1 through 550_5. As a result, data signals of the same polarity are applied to odd column row-pixels and even column row-pixels with an interval of one horizontal period in the row direction.

In addition, data signals of alternate polarities are sequentially applied to column-pixels with an interval of one horizontal period in a column direction. That is, the LCD panel 500 substantially receives data signals in a similar way to the column inversion method. For example, in an odd frame, the odd data-lines 540_1 through 540_5 receive data signals of a first polarity and the even data-lines 550_1 through 550_5 receive data signals of a second polarity. Subsequently, in an even frame, the odd data-lines 540_1 through 540_5 receive data signals of the second polarity and the even data-lines 550_1 through 550_5 receive data signals of the first polarity.

The LCD panel 500 may further include the charge-sharing control circuit 560. The charge-sharing control circuit 560 controls the odd data-lines 540_1 through 540_5 to share electric charges and controls the even data-lines 550_1 through 550_5 to share electric charges. In one example embodiment, the charge-sharing control circuit 560 includes a plurality of first switches OST and a plurality of second switches EST. The first switches OST couple the odd data-lines 540_1 through 540_5 to each other in accordance with a charge-sharing control signal CSC. Likewise, the second switches EST couple the even data-lines 550_1 through 550_5 to each other in accordance with the charge-sharing control signal CSC.

For example, in one example embodiment, the charge-sharing control signal CSC is a pre charge-sharing (PCS) signal. In addition, the first switches OST and the second switches EST turn on before the pixels 510 coupled to the row-lines (i.e., the first sub gate-line 520_1, the second sub gate-line 520_2, and the gate-lines 530_1 through 530_*k*) are charged. In another example embodiment, the first switches OST and the second switches EST turn on after the pixels 510 coupled to the row-lines are charged. Thus, the odd data-lines 540_1 through 540_5 share electric charges and the even data-lines 550_1 through 550_5 share electric charges.

Therefore, the LCD panel 500 having the charge-sharing control circuit 560 may reduce power consumption in cases such as when the data signals have fickle patterns and may enhance charging-characteristics of the pixels 510 to have high performance. In FIG. 8, it is illustrated that the LCD panel 500 includes the charge-sharing control circuit 560. However, the charge-sharing control circuit 560 may be embedded in an integrated circuit (IC) in other embodiments.

Figure 9:
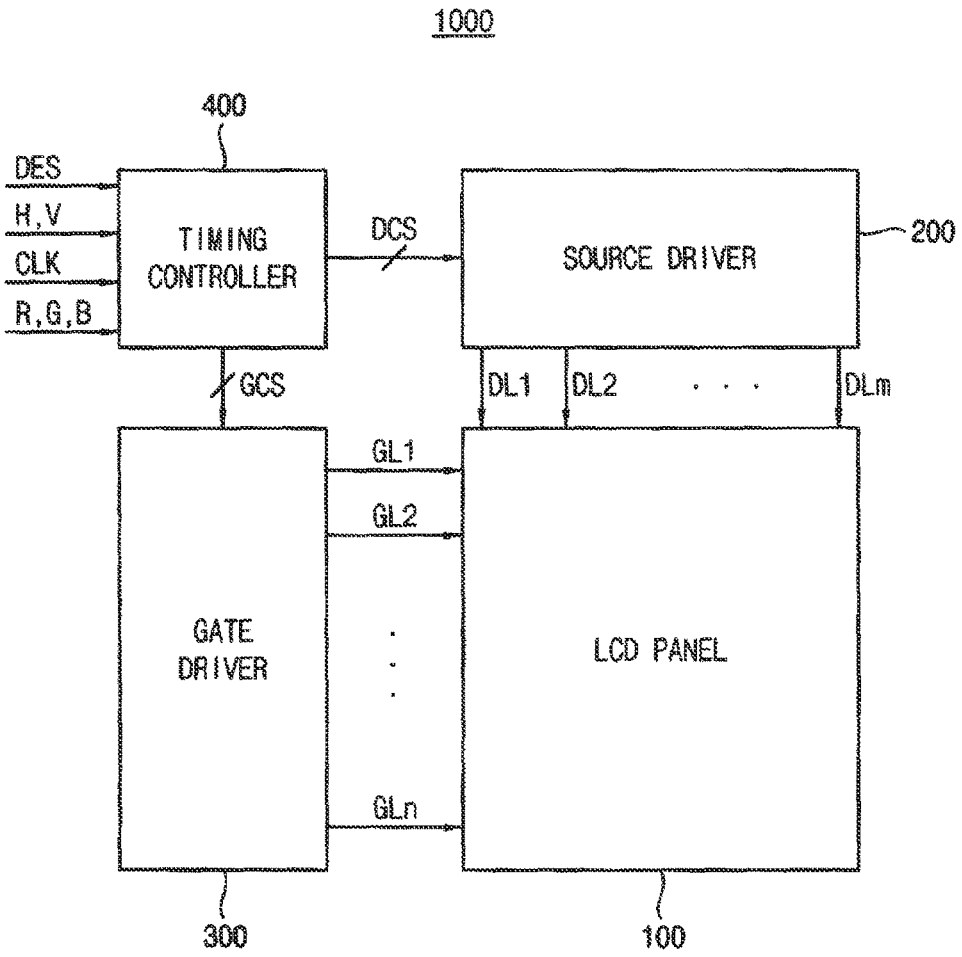
FIG. 9 is a block diagram illustrating an LCD device in accordance with example embodiments.

FIG. 9 is a block diagram illustrating an LCD device 1000 in accordance with example embodiments.

Referring to FIG. 9, the LCD device 1000 includes an LCD panel 100, a source driver 200, a gate driver 300, and a timing controller 400. Although not illustrated in FIG. 9, the LCD device 1000 may further include a gradation voltage generator that generates a plurality of gradation voltages. The gradation voltage generator may be coupled, for example, to the source driver 200.

The LCD panel 100 displays an image in accordance with data signals output from the source driver 200 and gate signals (i.e., a scan pulse) output from the gate driver 300. The LCD panel 100 includes a plurality of pixels. In a row direction, the pixels are divided into odd column row-pixels and even column row-pixels. In a column direction, the pixels are divided into odd row column-pixels and even row column-pixels.

As described above, "row-pixels" describe a plurality of pixels that are common to one row (including a subset of the pixels of one row, such as every other pixel) and "column-pixels" describe a plurality of pixels that are common to one column (including a subset of the pixels of one column, such as every other pixel). In the LCD panel 100, data signals of the same polarity are applied to odd column row-pixels and even column row-pixels with an interval of one horizontal period in the row direction. In addition, data signals of opposite polarities are sequentially applied to column-pixels with an interval of one horizontal period in the column direction. For these operations, the LCD panel 100 includes the pixels, the first sub gate-line, the second sub gate-line, the gate-lines, the odd data-lines, and the even data-lines as described earlier (see, for example, FIGS. 1 and 8).

The pixels are arranged in a matrix manner (that is, in rows and columns) at portions corresponding to crossing regions of the first sub gate-line, the second sub gate-line, the gate-lines, the odd data-lines, and the even data-lines. The first sub gate-line is coupled to first row-pixels that are adjacent to a lower side of the first sub gate-line and the second sub gate-line is coupled to second row-pixels that are adjacent to an upper side of the second sub gate-line. For instance, first row-pixels may correspond to (for example, are or include) the odd column row-pixels while second row-pixels may correspond to (for example, are or include) the even-column row-pixels.

The gate-lines are located (for example, placed) between the first sub gate-line and the second sub gate-line. Here, each of the gate-lines is coupled to second row-pixels that are adjacent to an upper side of the each of the gate-lines and first row-pixels that are adjacent to a lower side of the each of the gate-lines. In other words, each of the gate-lines is coupled to the pixels in zigzag fashion proceeding in the row direction along the gate-line.

The odd data-lines are coupled to second column-pixels that are adjacent to the odd data-lines. The even data-lines are coupled to first column-pixels that are adjacent to the even data-lines. For instance, second column-pixels may correspond to (for example, are or include) the even row column-pixels while first column-pixels may correspond to (for example, are or include) the odd row column-pixels.

The LCD panel 100 may further include a charge-sharing control circuit. The charge-sharing control circuit controls the odd data-lines to share electric charges and controls the even data-lines to share electric charges.

As described above, first row-pixels correspond to (for example, are or include) odd column row-pixels and second row-pixels correspond to (for example, are or include) even column row-pixels. In other embodiments, first row-pixels correspond to (for example, are or include) even column row-pixels and second row-pixels correspond to (for example, are or include) odd column row-pixels. Furthermore, as described above, first column-pixels correspond to (for example, are or include) odd row column-pixels and second column-pixels correspond to (for example, are or include) even row column-pixels. In other embodiments, first column-pixels correspond to (for example, are or include) even row column-pixels and second column-pixels correspond to (for example, are or include) odd row column-pixels.

In the LCD device 1000 of FIG. 9, the source driver 200 applies data signals to the data-lines DL1 through DLm of the LCD panel 100 in accordance with a data control signal DCS. The data control signal DCS is output from the timing controller 400. Here, data signals are generated by selecting gradation voltages generated by the gradation voltage generator (which is part of, or coupled to, the source driver 200).

In some example embodiments, the gradation voltage generator may generate pairs of gradation voltages (i.e., one has positive polarity relative to a common voltage and another has negative polarity relative to the common voltage).

The source driver 200 determines polarities of data signals by selecting gradation voltages of positive polarity or gradation voltages of negative polarity. Hence, data signals may have positive polarity relative to the common voltage or negative polarity relative to the common voltage.

In some example embodiments, the data control signal DCS includes a polarity control signal that controls polarities of data signals. In accordance with the polarity control signal, the LCD device 1000 periodically inverts polarities of data signals applied to the data-lines DL1 through DLm. In each frame, for example, the LCD device 1000 may apply data signals of a first polarity to even data-lines and may apply data signals of a second polarity to odd data-lines.

As described above, the LCD device 1000 inverts polarities of data signals (from a first polarity to a second polarity) provided to the LCD panel 100 with each frame (i.e., when the LCD device 1000 changes display frames from an odd frame to an even frame and from an even frame to an odd frame). For example, the first polarity may correspond to (for example, is) positive polarity while the second polarity corresponds to (for example, is) negative polarity. In other embodiments, the first polarity may correspond to (for example, is) negative polarity while the second polarity corresponds to (for example, is) positive polarity.

Continuing with the LCD device 1000 of FIG. 9, the gate driver 300 applies gate signals to gate-lines GL1 through GLn of the LCD panel 100 in accordance with a gate control signal GCS. The gate control signal GCS is output from the timing controller 400. In each frame, the gate signals are sequentially shifted (i.e., a scan pulse).

In addition, the timing controller 400 generates the gate control signal GCS and the data control signal DCS, which control driving timings for the LCD device 1000. In some example embodiments, the timing controller 400 receives a RGB image signal, a horizontal synchronization signal H, a vertical synchronization signal V, a main clock CLK, a data enable signal DES, etc., from an external graphic controller (not part of the LCD device 1000), and generates the gate control signal GCS and the data control signal DCS in accordance with these received signals.

For example, the gate control signal GCS may include a vertical synchronization start signal that controls an output start timing of gate signals, a gate clock signal that controls an output timing of gate signals, an output enable signal that controls a duration time of gate signals, etc. In addition, the data control signal DCS may include a horizontal synchronization start signal that controls an input start timing of data signals, a load signal that applies data signals to the data-lines DL1 through DLm, a polarity control signal that periodically inverts polarities of the data signals, etc.

Figure 10:
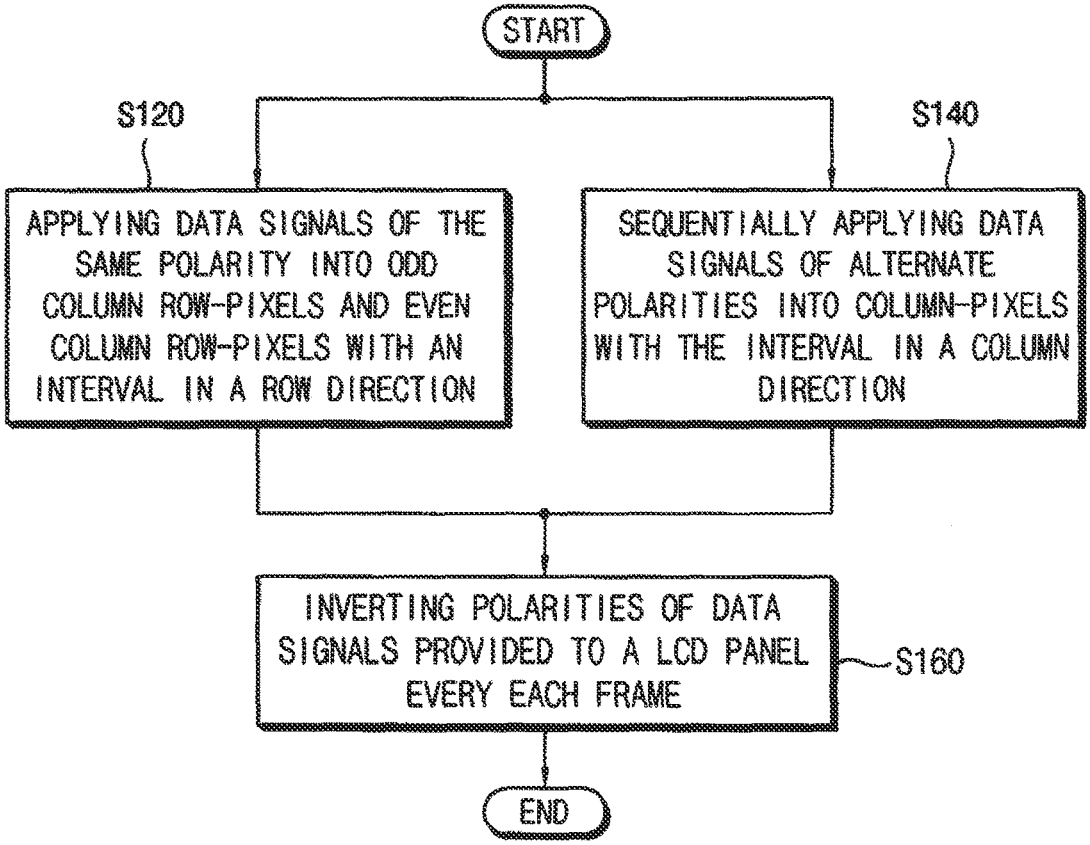
FIG. 10 is a flow chart illustrating a method of driving the LCD device of FIG. 9.

FIG. 10 is a flow chart illustrating a method of driving the LCD device 1000 of FIG. 9.

Referring to FIG. 10, the LCD device 1000 displays an image in a frame unit. As described above, each frame includes a plurality of horizontal periods. In the method of FIG. 10, data signals of the same polarity are applied to odd column row-pixels and even column row-pixels with an interval of one horizontal period in a row direction (Step S120). Further, data signals of opposite polarities are sequentially applied to column-pixels with an interval of one horizontal period in a column direction (Step S140). Subsequently, polarities of data signals provided to the LCD panel 100 are inverted with each frame (i.e., when the LCD device 1000 changes display frames from an odd frame to an even frame and from an even frame to an odd frame).

Through Steps S120 and S140, the method of FIG. 10 may reduce or prevent horizontal crosstalk and vertical crosstalk while efficiently reducing power consumption. In detail, horizontal crosstalk may be reduced or prevented because data signals of the same polarity are applied to odd column row-pixels and even column row-pixels with an interval of one horizontal period in a row direction (Step S120). For example, during a first horizontal period, data signals of a first polarity may be concurrently (e.g., simultaneously) applied to odd column row-pixels among a plurality of pixels that constitute a first row. Then, during a second horizontal period, data signals of a first polarity may be concurrently (e.g., simultaneously) applied to even column row-pixels among the pixels that constitute the first row.

Further, vertical crosstalk may be reduced or prevented because data signals of opposite polarities are sequentially applied to column-pixels with an interval of one horizontal period in a column direction (Step S140). For example, during a first horizontal period, data signals of a first polarity are applied to the first row column-pixels. Then, during a second horizontal period, data signals of a second polarity are applied to the corresponding second row column-pixels. Then, during a third horizontal period, data signals of the first polarity are applied to the corresponding third row column-pixels. Then, during a fourth horizontal period, data signals of the second polarity are applied to the corresponding fourth row column-pixels, etc.

Steps S120 and S140 may be performed, for example, in a frame unit. That is, in order to reduce or prevent deterioration of liquid crystal capacitors in the pixels due to polarization, the method of FIG. 10 inverts polarities of data signals provided to the LCD panel 100 with each frame (Step S160). For example, in a first frame (e.g., an odd frame), data signals applied to odd data-lines may have a first polarity while data signals applied to even data-lines may have a second polarity. Then, in a second frame (e.g., an even frame), data signals applied to odd data-lines have the second polarity while data signals applied to even data-lines have the first polarity. Then, in a third frame (e.g., an odd frame), data signals applied to odd data-lines have the first polarity while data signals applied to even data-lines have the second polarity.

Here, power consumption may be efficiently reduced because polarities of data signals are inverted with respect to alternating data-lines. As described above, a driver polarity pattern of an embodiment of the present invention may be similar to a driver polarity pattern of the column inversion method. On the other hand, because of the characteristics of this embodiment of the present invention, namely that data signals are applied to odd column row-pixels and even column row-pixels with an interval of one horizontal period in a row direction, an apparent polarity pattern of this embodiment of the present invention is similar to an apparent polarity pattern of the ALS inversion method and the line inversion method.

Figure 11:
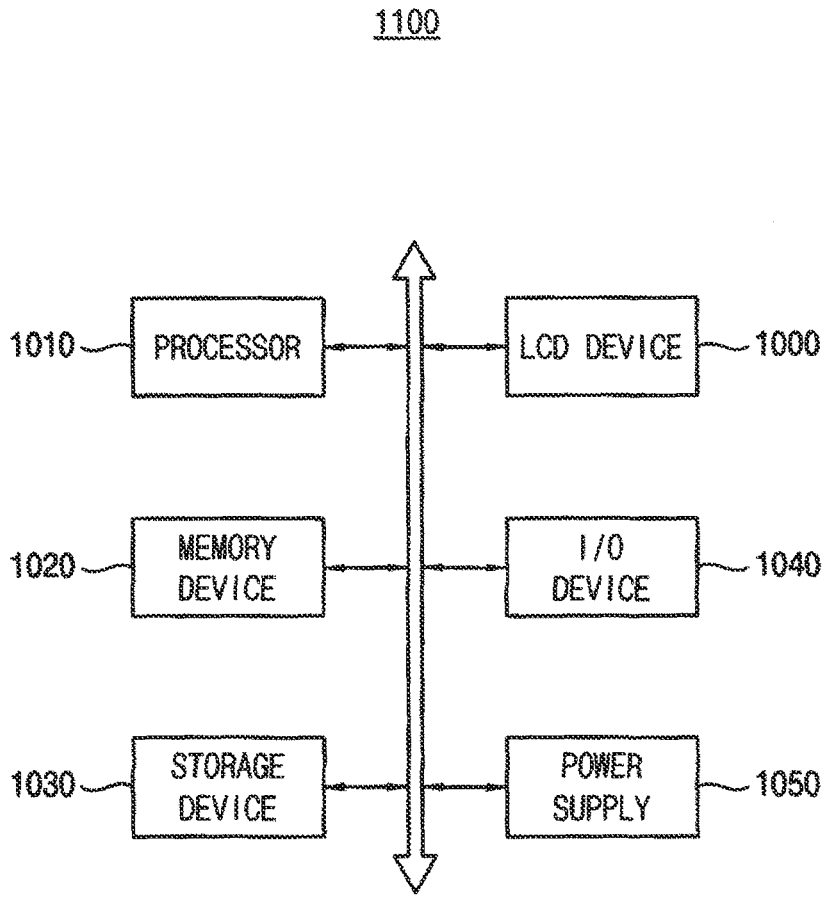
FIG. 11 is a block diagram illustrating an electric device having the LCD device of FIG. 9.

FIG. 11 is a block diagram illustrating an electric device 1100 having the LCD device 1000 of FIG. 9.

Referring to FIG. 11, the electric device 1100 includes the LCD device 1000, a processor 1010, a memory device 1020, a storage device 1030, an I/O device 1040, and a power supply 1050. The electric device 1100 may correspond to (for example, be) a digital television, a cellular phone, a smart phone, a computer monitor, etc. In some example embodiments, the electric device 1100 may further include a plurality of ports that communicate with a video card, a sound card, a memory card, a universal serial bus (USB) device, other electric devices, etc.

In the electric device 1100 of FIG. 11, the processor 1010 performs specific calculations or computing functions for various tasks. For example, the processor 1010 may correspond to (for example, be) a microprocessor, a central processing unit (CPU), etc. The processor 1010 may be coupled to the memory device 1020, the storage device 1030, and the I/O device 1040 via an address bus, a control bus, and/or a data bus. In addition, the processor 1010 may be coupled to an extended bus such as a peripheral component interconnection (PCI) bus.

The memory device 1020 stores data for operations of the electric device 1100. For example, the memory device 1020 may include at least one volatile memory device such as a dynamic random access memory (DRAM) device, a static random access memory (SRAM) device, etc. and/or at least one non-volatile memory device such as an erasable programmable read-only memory (EPROM) device, an electrically erasable programmable read-only memory (EEPROM) device, a flash memory device, etc.

The storage device 1030 may correspond to (for example, be) a solid-state drive (SSD), a hard disk drive (HHD), a CD-ROM, etc. The I/O device 1040 may include at least one input device (e.g., a keyboard, keypad, a mouse, etc.) and/or at least one output device (e.g., a printer, a speaker, etc.). In some example embodiments, the LCD device 1000 may be included in the I/O device 1040. The power supply 1050 supplies various voltages for operations of the electric device 1100.

The LCD device 1000 may communicate with the processor 1010 via the buses and/or other communication links. As described above, the LCD device 1000 includes the LCD panel 100, the source driver 200, the gate driver 300, and the timing controller 400.

The LCD panel 100 displays an image using the data signals output from the source driver 200 and gate signals output from the gate driver 300. Here, for example, data signals of the same polarity are applied to odd column row-pixels and even column row-pixels with an interval of one horizontal period in a row direction. Further, data signals of opposite polarities are sequentially applied to column-pixels with an interval of one horizontal period in a column direction.

For these operations, the LCD panel 100 includes a plurality of pixels, a first sub gate-line, a second sub gate-line, a plurality of gate-lines, a plurality of odd data-lines, and a plurality of even data-lines. In some example embodiments, the LCD panel 100 further includes a charge-sharing control circuit. The LCD device 1000 may be applied to a twisted nematic (TN) mode, a vertical alignment (VA) mode, an in plane switching (IPS) mode, a fringe field switching (FFS) mode, etc.

Embodiments of the present invention may be applied, for example, to a liquid crystal display (LCD) device and an electric device having the LCD device. Thus, embodiments of the present invention may be applied to a computer monitor, a digital television, a laptop, a digital camera, a video camcorder, a cellular phone, a smart phone, a portable multimedia player (PMP), a personal digital assistant (PDA), a MP3 player, a navigation device, a video phone, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings, aspects, and principles of the present invention. Accordingly, all such modifications are intended to be included within the scope of the present invention as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims, and their equivalents.

What is claimed is:

1. A liquid crystal display (LCD) panel comprising:

a plurality of pixels arranged in rows of row-pixels and in columns of column-pixels, each of the rows of row-pixels extending in a gate-line direction and comprising first positioned row-pixels and second positioned row-pixels, each of the columns of column-pixels extending in a data-line direction crossing the gate-line direction and comprising first positioned column-pixels and second positioned column-pixels;

a plurality of gate-lines extending in the gate-line direction, each row of the rows of row-pixels being between and adjacent to two of the gate-lines, an upper gate-line of the two of the gate-lines being coupled to the first positioned row-pixels of the row and a lower gate-line of the two of the gate-lines being coupled to the second positioned row-pixels of the same row, each gate-line of the gate-lines other than an uppermost gate-line and a lowermost gate-line of the gate-lines being between and adjacent to two of the rows of row-pixels, an upper row of the two of the rows of row-pixels having its second positioned row-pixels coupled to the gate-line and a lower row of the two of the rows of row-pixels having its first positioned row-pixels coupled to the same gate-line; and a plurality of data-lines extending in the data-line direction, each column of the columns of column-pixels being between and adjacent to two of the data-lines, a left data-line of the two of the data-lines being coupled to the first positioned column-pixels of the column and a right data-line of the two of the data-lines being coupled to the second positioned column-pixels of the same column, each data-line of the data-lines other than a leftmost data-line and a rightmost data-line of the data-lines being between and adjacent to two of the columns of column-pixels, a left column of the two of the columns of column-pixels having its second positioned column-pixels coupled to the data-line and a right column of the two of the columns of column-pixels having its first positioned column-pixels coupled to the same data-line, wherein each group of four of the pixels adjacent to a same one of the gate-lines and a same one of the data-lines comprises:

a first pixel belonging to the first positioned row-pixels and the first positioned column-pixels;

a second pixel belonging to the first positioned row-pixels and the second positioned column-pixels;

a third pixel belonging to the second positioned row-pixels and the first positioned column-pixels; and a fourth pixel belonging to the second positioned row-pixels and the second positioned column-pixels, wherein the first and third pixels are directly coupled to the same one of the gate-lines or the second and fourth pixels are directly coupled to the same one of the gate-lines, and wherein the first and fourth pixels are directly coupled to the same one of the data-lines or the second and third pixels are directly coupled to the same one of the data-lines.

2. The LCD panel of claim 1, wherein the columns of column-pixels comprise even columns of column-pixels and odd columns of column-pixels alternating with the even columns of column-pixels, and wherein for each row of the rows of row-pixels, the first positioned row-pixels comprise odd column row-pixels and the second positioned row-pixels comprise even column row-pixels, the odd column row-pixels comprising those row-pixels of the row belonging to the odd columns of column-pixels, the even column row-pixels comprising those row-pixels of the row belonging to the even columns of column-pixels.

3. The LCD panel of claim 2, wherein the rows of row-pixels comprise even rows of row-pixels and odd rows of row-pixels alternating with the even rows of row-pixels, wherein for each odd column of the odd columns of column-pixels, the first positioned column-pixels comprise even row column-pixels and the second positioned column-pixels comprise odd row column-pixels, the odd row column-pixels comprising those column-pixels of the odd column belonging to the odd rows of row-pixels, the even row column-pixels comprising those column-pixels of the odd column belonging to the even rows of row-pixels, and wherein for each even column of the even columns of column-pixels, the first positioned column-pixels comprise odd row column-pixels and the second positioned column-pixels comprise even row column-pixels, the odd row column-pixels comprising those column-pixels of the even column belonging to the odd rows of row-pixels, the even row column-pixels comprising those column-pixels of the even column belonging to the even rows of row-pixels.

4. The LCD panel of claim 2, wherein the rows of row-pixels comprise even rows of row-pixels and odd rows of row-pixels alternating with the even rows of row-pixels, wherein for each odd column of the odd columns of column-pixels, the first positioned column-pixels comprise odd row column-pixels and the second positioned column-pixels comprise even row column-pixels, the odd row column-pixels comprising those column-pixels of the odd column belonging to the odd rows of row-pixels, the even row column-pixels comprising those column-pixels of the odd column belonging to the even rows of row-pixels, and wherein for each even column of the even columns of column-pixels, the first positioned column-pixels comprise even row column-pixels and the second positioned column-pixels comprise odd row column-pixels, the even row column-pixels comprising those column-pixels of the even column belonging to the even rows of row-pixels, the odd row column-pixels comprising those column-pixels of the even column belonging to the odd rows of row-pixels.

5. The LCD panel of claim 1, wherein the columns of column-pixels comprise even columns of column-pixels and odd columns of column-pixels alternating with the even columns of column-pixels, and wherein for each row of the rows of row-pixels, the first positioned row-pixels comprise even column row-pixels and the second positioned row-pixels comprise odd column row-pixels, the even column row-pixels comprising those row-pixels of the row belonging to the even columns of column-pixels, the odd column row-pixels comprising those row-pixels of the row belonging to the odd columns of column-pixels.

6. The LCD panel of claim 5, wherein the rows of row-pixels comprise even rows of row-pixels and odd rows of row-pixels alternating with the even rows of row-pixels, wherein for each odd column of the odd columns of column-pixels, the first positioned column-pixels comprise even row column-pixels and the second positioned column-pixels comprise odd row column-pixels, the odd row column-pixels comprising those column-pixels of the odd column belonging to the odd rows of row-pixels, the even row column-pixels comprising those column-pixels of the odd column belonging to the even rows of row-pixels, and wherein for each even column of the even columns of column-pixels, the first positioned column-pixels comprise odd row column-pixels and the second positioned column-pixels comprise even row column-pixels, the odd row column-pixels comprising those column-pixels of the even column belonging to the odd rows of row-pixels, the even row column-pixels comprising those column-pixels of the even column belonging to the even rows of row-pixels.

7. The LCD panel of claim 5, wherein the rows of row-pixels comprise even rows of row-pixels and odd rows of row-pixels alternating with the even rows of row-pixels, wherein for each odd column of the odd columns of column-pixels, the first positioned column-pixels comprise odd row column-pixels and the second positioned column-pixels comprise even row column-pixels, the odd row column-pixels comprising those column-pixels of the odd column belonging to the odd rows of row-pixels, the even row column-pixels comprising those column-pixels of the odd column belonging to the even rows of row-pixels, and wherein for each even column of the even columns of column-pixels, the first positioned column-pixels comprise even row column-pixels and the second positioned column-pixels comprise odd row column-pixels, the even row column-pixels comprising those column-pixels of the even column belonging to the even rows of row-pixels, the odd row column-pixels comprising those column-pixels of the even column belonging to the odd rows of row-pixels.

8. The LCD panel of claim 1, wherein the data-lines comprise a plurality of odd data-lines and a plurality of even data-lines alternating with the odd data-lines, and wherein in an odd frame, the odd data-lines are configured to receive data signals of a first polarity and the even data-lines are configured to receive data signals of a second polarity, the second polarity being opposite to the first polarity.

9. The LCD panel of claim 8, wherein in an even frame, the odd data-lines are configured to receive data signals of the second polarity and the even data-lines are configured to receive data signals of the first polarity.

10. The LCD panel of claim 9, wherein the first polarity is positive polarity relative to a common voltage and the second polarity is negative polarity relative to the common voltage.

11. The LCD panel of claim 9, wherein the first polarity is negative polarity relative to a common voltage and the second polarity is positive polarity relative to the common voltage.

12. The LCD panel of claim 1, wherein the data-lines comprise a plurality of odd data-lines and a plurality of even data-lines alternating with the odd data-lines, the LCD panel further comprising a charge-sharing control circuit configured to control the odd data-lines to share electric charges in accordance with a charge-sharing control signal and to control the even data-lines to share electric charges in accordance with the charge-sharing control signal.

13. The LCD panel of claim 12, wherein the charge-sharing control circuit comprises:

a plurality of first switches configured to couple the odd data-lines to each other in accordance with the charge-sharing control signal; and a plurality of second switches configured to couple the even data-lines to each other in accordance with the charge-sharing control signal.

14. The LCD panel of claim 13, wherein the charge-sharing control signal comprises a pre charge-sharing (PCS) signal, and wherein the first switches and the second switches are configured to turn on before row-pixels coupled to the plurality of gate-lines are charged.

15. The LCD panel of claim 13, wherein the charge-sharing control signal comprises a pre charge-sharing (PCS) signal, and wherein the first switches and the second switches are configured to turn on after row-pixels coupled to the plurality of gate-lines are charged.

16. The LCD panel of claim 1, wherein the data-lines comprise a plurality of odd data-lines and a plurality of even data-lines alternating with the odd data-lines, and wherein each of the pixels comprises:

a switching element configured to perform switching operations in accordance with a gate signal output from one of the gate-lines; and a liquid crystal capacitor configured to control light transmittance of a liquid crystal layer in accordance with a data signal output from one of the odd data-lines or one of the even data-lines.

17. The LCD panel of claim 16, wherein the switching element comprises a thin film transistor (TFT) that includes a gate terminal for receiving the gate signal, a source terminal for receiving the data signal, and a drain terminal for outputting the data signal to the liquid crystal capacitor.

18. The LCD panel of claim 17, wherein each of the pixels further comprises a storage capacitor configured to maintain a charged voltage of the liquid crystal capacitor.

* * * * *